US008808208B2

(12) United States Patent
Mouatt

(10) Patent No.: US 8,808,208 B2
(45) Date of Patent: Aug. 19, 2014

(54) EXERCISE APPARATUS

(76) Inventor: Corey Philip Mouatt, St Lucia (AU)

( * ) Notice: Subject to any disclaimer, the term of this patent is extended or adjusted under 35 U.S.C. 154(b) by 1150 days.

(21) Appl. No.: 12/447,243

(22) PCT Filed: Oct. 25, 2007

(86) PCT No.: PCT/AU2007/001623
§ 371 (c)(1),
(2), (4) Date: Apr. 6, 2010

(87) PCT Pub. No.: WO2008/049165
PCT Pub. Date: May 2, 2008

(65) Prior Publication Data
US 2010/0191161 A1 Jul. 29, 2010

(30) Foreign Application Priority Data
Oct. 25, 2006 (AU) ..... 2006905946

(51) Int. Cl.
*A61H 7/00* (2006.01)

(52) U.S. Cl.
USPC ..... 601/135; 601/134; 601/137; 601/118; 606/204; 482/131

(58) Field of Classification Search
USPC ..... 601/134, 135, 136, 137, 143, 71, 112, 601/113, 118–120, 123, 124, 125, 129; 482/108, 109, 122, 131; 411/21, 22, 411/45, 80.1, 80.6, 509, 913; 606/204
See application file for complete search history.

(56) References Cited

U.S. PATENT DOCUMENTS

| | | | | | |
|---|---|---|---|---|---|
| 818,087 | A | * | 4/1906 | Harris | 24/110 |
| 2,941,439 | A | * | 6/1960 | Rapata | 411/41 |
| 3,461,859 | A | * | 8/1969 | Fortnam | 601/74 |
| 3,787,131 | A | * | 1/1974 | Reachek | 403/234 |
| 4,376,806 | A | * | 3/1983 | Intrater et al. | 428/469 |
| 4,449,877 | A | * | 5/1984 | Kessler | 411/80.5 |
| 4,452,237 | A | * | 6/1984 | Lewis | 601/134 |
| 4,493,315 | A | * | 1/1985 | Iwahashi | 601/135 |
| 4,520,798 | A | * | 6/1985 | Lewis | 606/204 |
| 4,674,930 | A | * | 6/1987 | Poe et al. | 411/40 |
| 4,786,225 | A | * | 11/1988 | Poe et al. | 411/32 |
| 4,944,747 | A | * | 7/1990 | Newth et al. | 606/204 |
| 5,577,996 | A | | 11/1996 | Gardner et al. | |
| 5,730,708 | A | * | 3/1998 | Spratt | 601/118 |
| 7,335,171 | B2 | * | 2/2008 | Ewell et al. | 601/135 |
| 2006/0052223 | A1 | * | 3/2006 | Terry | 482/126 |

(Continued)

FOREIGN PATENT DOCUMENTS

| | | |
|---|---|---|
| GB | 1410994 | 10/1975 |
| GB | 2271292 | 4/1994 |

(Continued)

OTHER PUBLICATIONS

International Search Report for PCT/AU2007/001623 mailed Apr. 18, 2008 (3 pages).

(Continued)

*Primary Examiner* — Quang D Thanh
(74) *Attorney, Agent, or Firm* — Osha Liang LLP

(57) ABSTRACT

An exercise apparatus (260) comprises a plurality of modules (100, 120, 130, 180) which are able to be detachably secured relative to each other in a plurality of configurations.

15 Claims, 16 Drawing Sheets

(56) References Cited

U.S. PATENT DOCUMENTS

| | | | | |
|---|---|---|---|---|
| 2007/0129656 | A1* | 6/2007 | Brooks | 601/135 |
| 2008/0108484 | A1* | 5/2008 | Wu et al. | 601/118 |
| 2008/0200853 | A1* | 8/2008 | Tielve | 601/134 |
| 2009/0105619 | A1* | 4/2009 | Kim | 601/134 |
| 2011/0087140 | A1* | 4/2011 | Lee | 601/137 |
| 2013/0023807 | A1* | 1/2013 | Hennessey | 601/137 |

FOREIGN PATENT DOCUMENTS

| | | |
|---|---|---|
| JP | 2006-305112 | 11/2006 |
| RU | 2141300 | 11/1999 |
| RU | 2004125912 | 1/2005 |
| RU | 2270659 | 2/2006 |
| WO | 97/46201 | 12/1997 |

OTHER PUBLICATIONS

Written Opinion of ISA mailed Apr. 18, 2008 (3 pages).

International Preliminary Report on Patentability for PCT/AU2007/001623 dated Feb. 6, 2009 (3 pages).

Derwent Abstract Accession No. 2000-489757/43, Class P33, RU 2141300 C1 (Patsek, AV) dated Nov. 20, 1999 (1 page) (Relates to Foreign Reference 1 above).

Derwent Abstract Accession No. 2006-180324/19, Class P33, RU 2270659 C2 (Poryadkov, LF) dated Feb. 27, 2006 (1 page) (Relates to Foreign Reference 2 above).

Patent Abstracts of Japan 2006-305112 dated Nov. 9, 2006 (1 page).

European Search Report for European Application No. 07815428, mailed on Feb. 2, 2011 (6 pages).

* cited by examiner

FIGURE 18
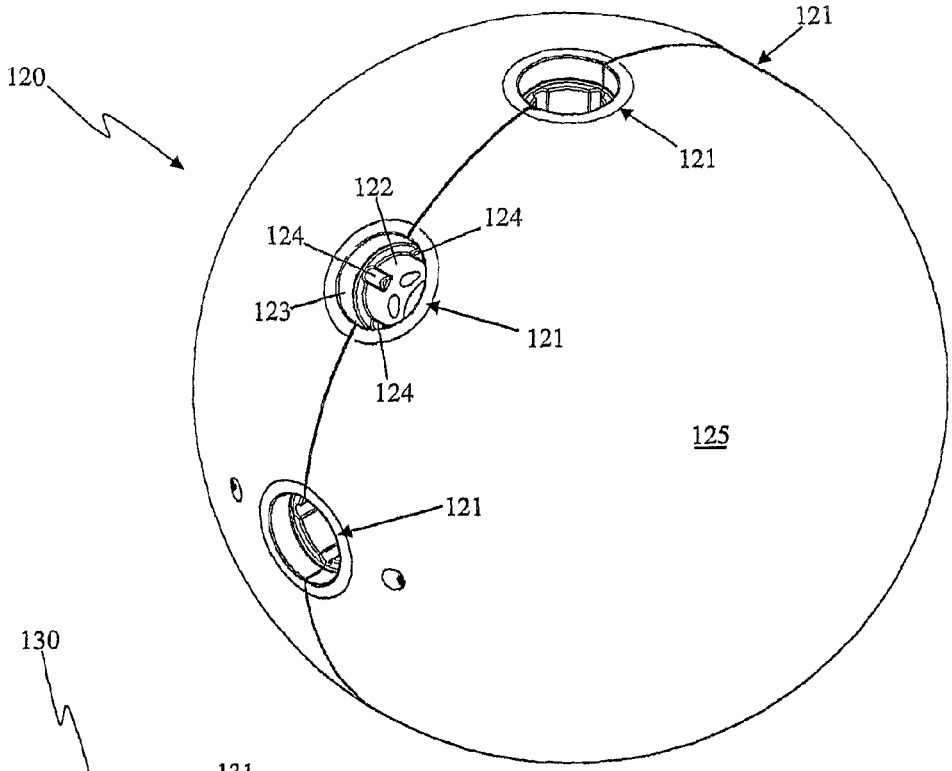
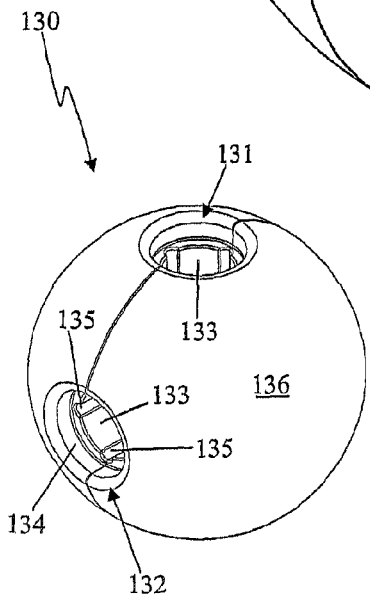
FIGURE 19
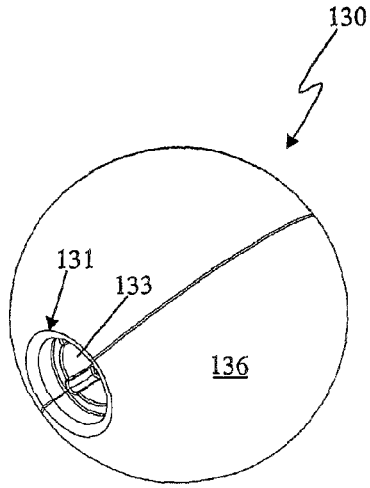
FIGURE 20

FIGURE 31
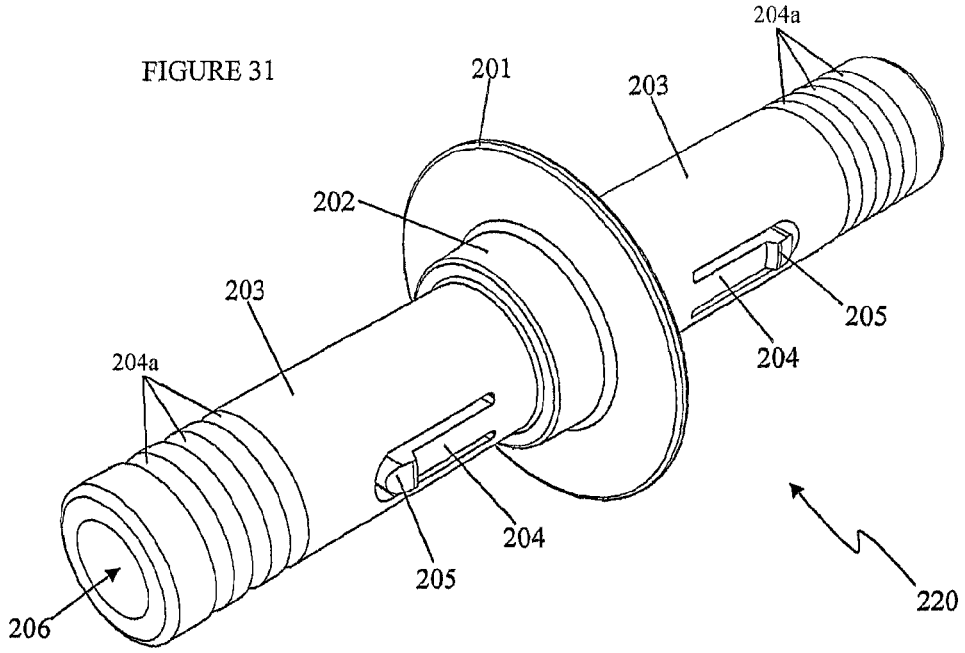
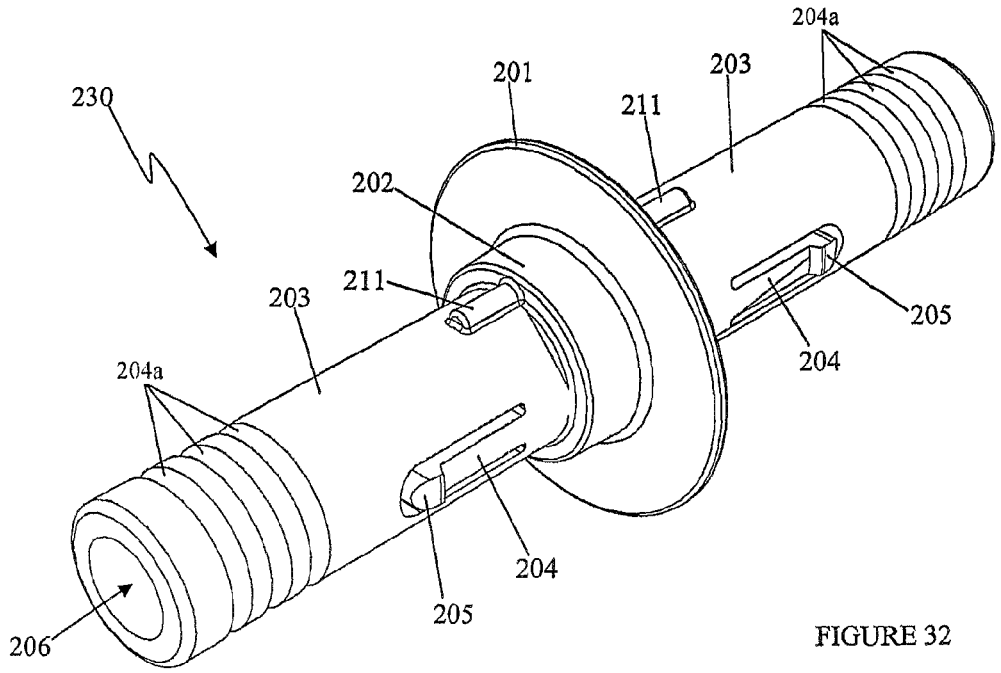
FIGURE 32

EXERCISE APPARATUS

FIELD OF THE INVENTION

The present invention relates generally to physical exercise and, in particular, to an exercise apparatus.

The invention has been developed to enable people to self-manage their own physical health and well-being. Although the invention will be described with particular reference to providing pain relief to sufferers of musculoskeletal pain, it will be appreciated that the invention is not necessarily limited to this particular use.

BRIEF DISCUSSION OF THE PRIOR ART

Joint pain and muscle pain are collectively referred to as musculoskeletal pain. Various treatments for musculoskeletal pain have been developed over the years. Some treatments involve the use of some type of massage apparatus. Various massage apparatus have been developed which assist suffers of musculoskeletal pain to treat themselves.

An example of such an apparatus is the subject of Australian design registration no. 149019 and is marketed under the registered trade mark BakBalls. The BakBalls massage apparatus includes a pair of balls which are joined together. Amongst other things, the BakBalls apparatus may be used to treat joint stiffness in a person's back.

The BakBalls apparatus can be used by a person to treat joint stiffness in their back by firstly positioning the apparatus between their shoulder blades so that the balls of the apparatus are positioned on either side of their spine. Next, while lying on the device, the person moves back and forth so that the balls roll back and forth along their spine and thereby massage their spine.

In addition to treating joint stiffness in a person's back, the Bakballs massage apparatus can also be used by a person to correct their posture, and to massage other parts of their body such as the balls of their feet, leg muscles or their shoulder muscles, for example.

The BakBalls apparatus suffers from the drawback that it is somewhat limited in terms of the number of ways in which it can be employed by a person as a massage apparatus for the treatment of musculoskeletal pain. Moreover, it is also somewhat limited in that it is essentially just a massage apparatus and is not particularly suited for any other purpose.

In addition, the BakBalls apparatus may not be suitable for use by some people due to differences in people's body shape and size, and also due to health considerations which may preclude some people from being able to use the BakBalls apparatus.

Examples of other known massage devices are disclosed in U.S. Pat. No. 5,577,996 (Gardner et al.), Russian Patent No. 2,141,300 (Patsek), Russian Patent No. 2,270,659 (Poryadkov), and Japanese Patent Publication No. 2006-305112 (Toshikatsu).

U.S. Pat. No. 5,577,996 (Gardner et al.) discloses a hand held massage device having a plurality of spheres adjustably mounted on an axial rod with enlarged grip handles mounted on the outer ends of the rod for rotation. The spheres of the massage device may be adjusted to various positions along the axis of the rod to comfort and to direct the massage to specific areas of a user's body.

Russian Patent No. 2,141,300 (Patsek) discloses a device for self-massaging deep muscles of the back and neck. The device includes a case with massaging members arranged on it. The massaging members are spaced apart from each other such that the spaces correspond to boundaries of the paravertebral region of the thoracic and lumbar sections of the vertebral column of a user. The massaging members are coupled to one another over a curvilinear surface of the case. The case consists of two halves, a cross-section of which has a five-pointed star configuration. Four projections of the star are provided by spherical members. The spherical members are designed to be used to massage deep paravertebral muscles. The fifth projection of the star is barrel-shaped, and is designed to be used for massaging neck muscles and surface muscles of the back.

Russian Patent No. 2,270,659 (Poryadkov) discloses a massager which can be used for sanitary and prophylactic massage. The massager includes a case onto which removable massage elements are mounted by means of holders fixed onto the case. The removable massage elements have spherical working surfaces. The massager also has a handle. The massage elements are disposed along a circle on a horizontal plane. The holders are inclined relative to an axis of the massager. There are holes in the holders into which holes the shanks of different-temperature massage elements are inserted. Grooves are formed at free ends of the shanks, and a spring-loaded stop disc interacts with the grooves. The massage elements can be made in the form of an airtight container filled with some known refrigerating medium or with a high heat-capacity medium. Different shaped protrusions can be made onto the working surface of the massage elements to improve their massage effect. To make usage more comfortable, "cold" and "warm" massage elements are painted in different colours.

Japanese Patent Publication No. 2006-305112 (Toshikatsu) discloses a massage device. The device includes a pair of spheres and a flexible handle part which connects the spheres at a suitable spacing. A string-like member is arranged in the centre of the handle part. Cushion members are provided around the string-like member. The spheres are connected with both ends of the string-like member which is located in the centre of the handle part. Two or more of the cushion members have different degrees of flexibility.

Like the BakBalls apparatus, the Gardner et al., Patesk, Poryadkov and Toshikatsu devices suffer from the drawback that they are limited in the number of ways in which they can be employed by a person as a massage apparatus, and that they are specifically designed only for massaging.

SUMMARY OF THE INVENTION

It is an object of the present invention to overcome, or at least ameliorate, one or more of the deficiencies of the prior art mentioned above, or to provide the consumer with a useful or commercial choice.

Other objects and advantages of the present invention will become apparent from the following description, taken in connection with the accompanying drawings, wherein, by way of illustration and example, a preferred embodiment of the present invention is disclosed.

In one broad form, the present invention resides in an exercise apparatus comprising a first module, a second module, and at least one plug, said first module being a rod module which includes a plurality of lateral openings for removably receiving said at least one plug, each said at least one plug being secured to the second module, and each said at least one plug being insertable into said lateral openings such that said first module and said second module are thereby able to be detachably secured relative to each other in a plurality of configurations.

The exercise apparatus according to the present invention may be configured as any suitable type of exercise apparatus.

For example, the apparatus may be configured as a musculoskeletal treatment apparatus such as, for example, a massage apparatus, so that one or more of the modules of the apparatus is able to apply pressure to, and massage, one or more specific muscles or trigger points of their body. The apparatus therefore enables a person to reduce their reliance on others for continuing management of a variety of musculoskeletal conditions such as, for example, headaches, arthritis, back/neck/shoulder pain, plantar fascia complaints, tennis elbow, and general muscle pain, and to generally treat their feet, knees, legs, shoulders, groin etc.

Alternatively, the exercise apparatus may be configured as a strength training apparatus for use in resistance training, or as a stretching apparatus for use as an aid in stretching exercises.

Regardless of the particular type of apparatus which the exercise apparatus is configured as, the apparatus can be configured by a user to suit their particular needs and requirements. For example, if the exercise apparatus is configured as a massage apparatus, the massage apparatus may be configured in a plurality of different ways to suit different people or so that it can be used to massage a particular part of a person's body.

The modules of the exercise apparatus may be of the same type or may be a combination of different types. Also, the modules of the apparatus may be any suitable size and shape.

The modules may be secured relative to each other such that they are able to rotate relative to each other. Alternatively, the modules may be secured relative to each other such that they are unable to rotate relative to each other.

The rod module may be any suitable shape. Preferably, the rod module is substantially cylindrical.

The rod module may be any suitable width. Preferably, the rod module has a width of 5 mm to 80 mm. It is particularly preferred that the rod module has a width of 40 mm.

The rod module may be any suitable length. Preferably, the rod module has a length of 10 mm to 500 mm. In a particular preferred form, the rod module is 300 mm long. In another particular preferred form, the rod module is 110 mm long.

The second module may be a ball module. The ball module may be any suitable diameter. Preferably, the ball module has a diameter of 20 mm to 110 mm.

The ball module may be selected from a range of different sizes. For example, the ball module may be a large, medium, or small ball module. It is preferred that the large, medium, and small ball modules have diameters of 90 mm, 65 mm, and 42 mm, respectively.

The second module may be a multi-spherical ball module. The multi-spherical ball module preferably comprises a large spherical portion and a plurality of smaller spherical portions projecting outwardly from the large spherical portion. The large spherical portion may be any suitable diameter. Preferably, the large spherical portion has a diameter of 10 mm to 50 mm. Likewise, the smaller spherical portions may be any suitable diameter. Preferably, each smaller spherical portion has a diameter of 10 mm to 30 mm.

The second module may be a toroidal module. The toroidal module is preferably a partial toroid. In a particular preferred form, the toroidal module is a half-toroid. The toroidal module may have any suitable internal diameter and external diameter. Preferably, the internal diameter of the toroid module is 10 mm to 50 mm, and the external diameter of the toroid module is 20 mm to 110 mm.

The second module may have a shape which is different to those mentioned above. For example, the second module may be a semi-spherical-, ellipsoidal-, or semi-ellipsoidal module.

The second module of the apparatus may be a strength training module for use by a person as an aid in their resistance/strength training. The strength training module preferably includes an elastic strap, and a respective anchor secured to each end of the strap, wherein each anchor includes a respective at least one plug.

The strap of the strength training module may be any type of elastic strap which is suitable for use in resistance training. In a particular preferred form, the strap comprises a length of elastic tubing.

The elastic strap of the strength training module may be any suitable length. Preferably, the elastic strap is 200 mm to 2000 mm long.

The anchors of the strength training module are preferably adapted so that the length of the portion of the elastic strap which extends between the anchors is able to be adjusted. Preferably, each anchor includes a plurality of openings for adjustably securing the elastic strap to the anchor.

The second module of the apparatus may be a stretching module for use by a person as an aid in their stretching exercises. The stretching module preferably includes a belt, and a respective anchor secured to each end of the belt, each anchor including a respective at least one plug.

The belt of the stretching module may be any type of belt which is suitable for use in stretching exercises. In a particular preferred form, the belt is a length of webbing.

The belt of the stretching module may be any suitable length. Preferably, the belt is 200 mm to 3000 mm long.

The anchors of the stretching module are preferably adapted so that the length of the portion of the belt which extends between the anchors is able to be adjusted. Preferably, each anchor includes a buckle portion for adjustably securing the belt to the anchors.

The apparatus may include one or more other modules which are able to be detachably secured relative to the other modules of the apparatus, and which are able to broaden the range of functionality of the apparatus. For example, the apparatus may include a wall-mountable plate module which is adapted to be detachably secured relative to one of the other modules of the apparatus so as to maintain the position of that other module relative to a user, and to prevent it from slipping on a surface which may be used to support the module when the apparatus is being used. The wall-mountable plate is preferably 50 mm square.

The rod module may also include a longitudinal opening which extends the length of the rod module from an end of the module to an opposite end of the module.

The second module preferably includes at least one opening for removably receiving the at least one plug. For example, in the case where the second module is a ball module, the ball module may include a plurality of openings for receiving the plug. The openings may be located anywhere on the ball module. For example, the openings may be unevenly distributed over the surface of the ball module, or they may be evenly distributed over the surface of the ball module. In a preferred form, the openings are distributed along the middle of the ball module. In a particular preferred form, the openings are evenly distributed along the middle of the ball module.

The plug may be any suitable shape. In a preferred form, the plug is in the form of a substantially cylindrical rod or pin.

The plug may be any suitable length. Preferably, the plug is 10 mm to 400 mm long.

The plug may be any suitable width. Preferably, the plug is 3 mm to 20 mm wide.

The profile or cross-section of the plug may be substantially constant along the length of the plug. Alternatively, the profile or cross-section of the plug may vary along its length. For example, one end of the plug may be wider than the other end of the plug.

It is preferred that the plug includes an opening. The opening may extend lengthways through the plug, or it may extend laterally through the plug. The opening may receive another plug so that respective modules of the apparatus to which each of the plugs are secured may themselves be secured relative to each other by inserting one of the plugs into the opening in the other plug.

The plug may be formed separately from the second module. For example, as mentioned above, the second module may include at least one opening for receiving the plug. Alternatively, the plug may be integrally formed with that module. For example, if the module is the strength training module or the stretching module, and each anchor of the module includes a respective plug, the plugs may be integrally formed with the anchors. Also, if the module is the ball module, multi-spherical ball module, or toroid module, the plug may form part of the module.

In another preferred form, the plug and the modules are separate and distinct components of the apparatus, and the plug is adapted to be inserted into a respective one of the openings in each one of a plurality of the modules such that those modules are thereby detachably secured relative to each other. It is preferred that the plug includes a flange which is able to limit the extent to which the plug is able to be inserted into the openings.

Advantageously, the plug and the openings in the modules into which the plug is inserted may be adapted to substantially interlock with each other such that the plug is inhibited from being withdrawn from the openings. For example, the openings may include a latch recess, and the plug may include a latch arm which is adapted to engage with the latch recess when the plug is inserted into the openings such that the plug is thereby inhibited from being withdrawn from the openings.

The plug and the module openings which receive the plug are preferably adapted to inhibit relative rotation between the plug and the openings. In a particular preferred form, the plug includes at least one ridge, and the openings include at least one groove for receiving the at least one ridge such that the plug is thereby inhibited from rotating relative to the openings.

The plug may be any suitable length. The plug may be a short plug or a long plug. Preferably, the long plug, unlike the short plug, is of sufficient length to be able to block other openings in the module into which the plug inserted, or to reinforce the module.

It is preferred that the plug is hollow, and that the apparatus also includes a locking pin which is able to be inserted into the hollow plug such that the pin is able to prevent the latch arm of the plug from disengaging with the latch recess of the module opening which receives the plug. By preventing the latch arm from disengaging with the latch recess, the locking pin is able to prevent, or at least further inhibit, the plug from being unintentionally removed from the opening. The locking pin is therefore particularly suitable for use where the apparatus is subjected to relatively high torsional loads which may increase the risk of unintentional disengagement of the latch arm from the latch recess which may lead to the plug being unintentionally withdrawn from the module opening.

The locking pin may be any suitable length. However, it is preferred that the locking pin is sufficiently long so that it is able to reinforce the modules of the apparatus which are secured together by the plug. Such reinforcement is particularly advantageous where the apparatus is subjected to relatively high loads such as high torsional loads which the modules of the apparatus may not be able to withstand without reinforcement.

In a preferred form, the locking pin includes an elongate shaft, and a head which is secured relative to the shaft. The head may be any suitable size and shape. Preferably, the head is substantially flat. In other embodiments however, the head may be somewhat bulbous. For example, the head may be spherical or some other shape. Preferably, the head is overmoulded with the shaft of the locking pin, Advantageously, at least some of the modules of the apparatus include a non-slip surface so that those modules are thereby able to be inhibited from slipping on a support surface which they may rest against when the apparatus is being used.

BRIEF DESCRIPTION OF THE DRAWINGS

In order that the invention may be more fully understood and put into practice, a preferred embodiment thereof will now be described with reference to the accompanying drawings, in which:

FIG. 18 depicts a large ball module of the exercise apparatus according to the second preferred embodiment of the present invention;

FIG. 19 is a first perspective view of a small ball module of the exercise apparatus according to the second preferred embodiment of the present invention;

FIG. 20 is a second perspective view of the ball module depicted in FIG. 19;

FIG. 31 is a perspective view of a long rotatable plug of the exercise apparatus according to the second preferred embodiment of the present invention;

FIG. 32 is a perspective view of a long non-rotatable plug of the exercise apparatus according to the second preferred embodiment of the present invention;

DETAILED DESCRIPTION OF THE DRAWINGS

Figure 1:
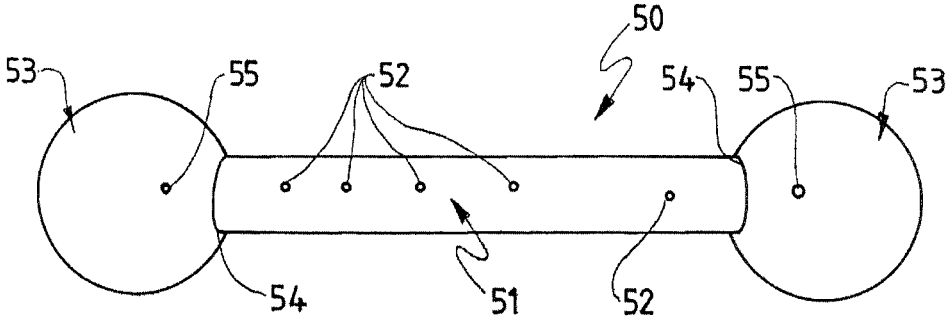
FIG. 1 depicts a first exemplary configuration of an exercise apparatus according to a first preferred embodiment of the present invention.

Referring to FIG. 1, an exercise apparatus 50 according to a first preferred embodiment of the present invention. Apparatus 50 is configured as a massage apparatus and includes an elongate rod module 51 which is in the form of a plastic cylindrical rod which has a diameter of 40 mm and which is 300 mm long. Rod module 51 includes a plurality of lateral circular openings 52 which extend all the way through the module 51. Openings 52 are spaced apart from each other along the length of the module 51 and around its perimeter.

A respective ball module 53 is detachably secured to each end of the rod module 51. Each ball module 53 has a diameter of 70 mm-110 mm and includes a large circular opening 54 which receives an end of the rod module 51 such that the ball module 53 is thereby detachably secured to the rod module 51. In addition, each ball module 53 includes a plurality of circular openings 55 at various locations.

Figure 2:
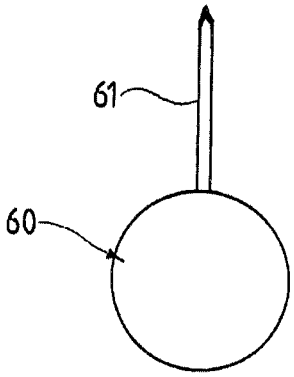
FIG. 2 depicts a small ball module of the exercise apparatus according to the first preferred embodiment of the present invention.

A ball module 60 which is smaller than the ball modules 53 and which is able to be detachably secured to the rod module 51 or to either one of the ball modules 53 is illustrated in FIG. 2. A plug 61 extends from the ball module 60. Plug 61 is actually a nail which has been driven into the ball module 60.

Plug 61 is able to be inserted into any one of the openings 52 in the rod module 51, or into any one of the openings 55 in either one of the large ball modules 53. In this way, the small ball module 60 is able to be detachably secured to the rod module 51 or to either one of the large ball modules 53. The small ball module 53 is able to be detached from the rod module 51 or the large ball modules 53 which it is secured to by simply withdrawing the plug 61 from the rod module 51 or the ball module 53 which the small ball module 53 is secured to.

Figure 3:
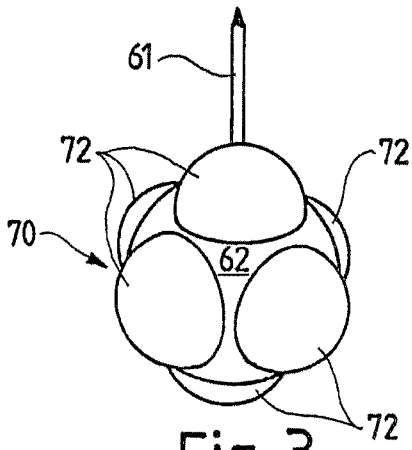
FIG. 3 depicts a multi-spherical ball module of the exercise apparatus according to the first preferred embodiment of the present invention.

FIG. 3 depicts a multi-spherical ball module 70 which is also able to be detachably secured to the rod module 51 or to either one of the large ball modules 53. Module 70 is smaller than the large ball modules 53. Module 70 includes a spherical portion 71 and a plurality of smaller spherical portions 72 which project outwardly from the spherical portion 71. Ball module 70 also includes a plug 61 for detachably securing the module 70 to either the rod module 51 or either one of the large ball modules 53.

Figure 4:
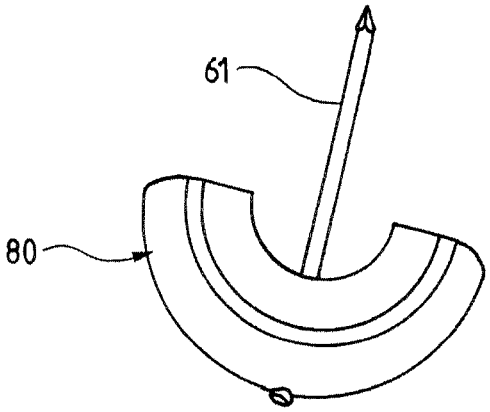
FIG. 4 depicts a half-toroid module of the exercise apparatus according to the first preferred embodiment of the present invention.

Referring to FIG. 4, a semi-toroid module 80 which includes a plug 61 is also able to be detachably secured to the rod module 51 or to either one of the large ball modules 53 of the apparatus 50.

The various modules 51, 53, 60, 70, 80 of the apparatus 50 are of substantially solid construction.

Figure 5:
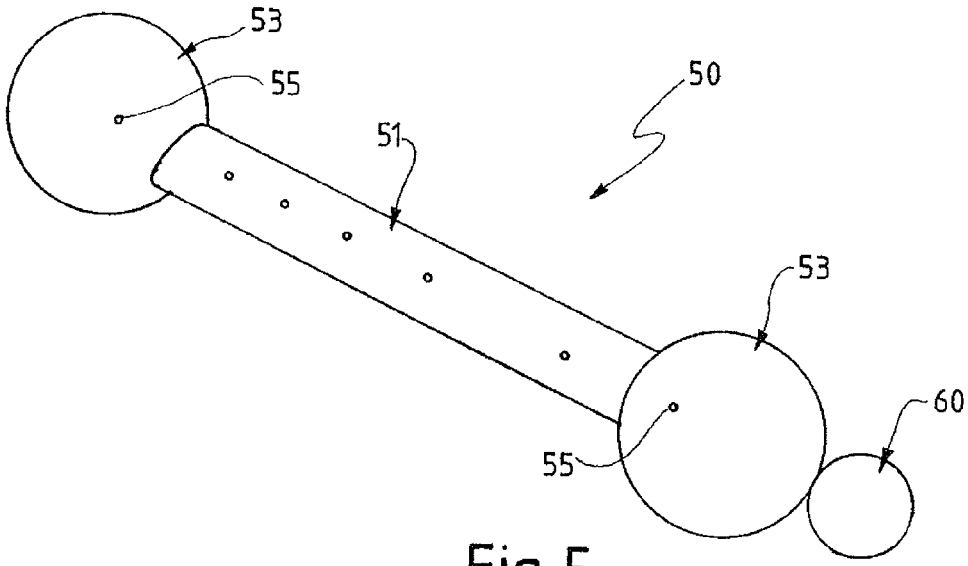
FIG. 5 depicts a second exemplary configuration of the exercise apparatus according to the first preferred embodiment of the present invention.

Referring to FIG. 5, the apparatus 50 is again configured as a massage apparatus and includes the small ball module 60. Module 60 is detachably secured to one of the large ball modules 53 of the apparatus 50 by inserting the plug 61 which extends from the ball module 60 into one of the openings 55 in the large ball module 53.

Figure 6:
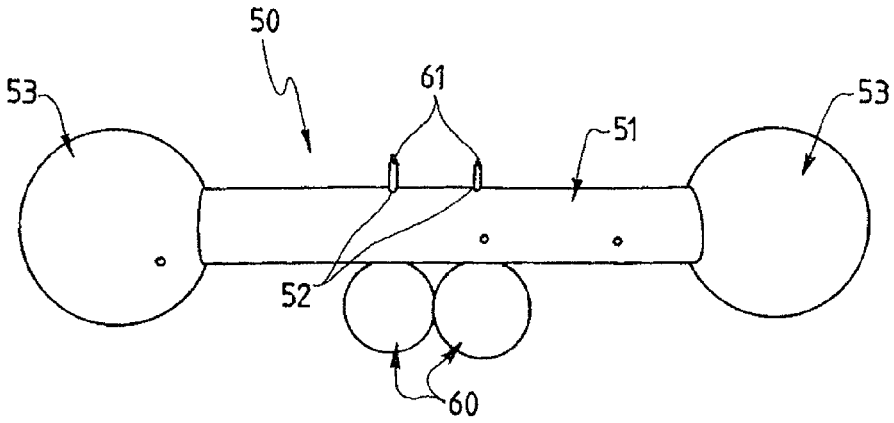
FIG. 6 depicts a third exemplary configuration of the exercise apparatus according to the first preferred embodiment of the present invention.

With reference to FIG. 6, the apparatus 50 is again configured as a massage apparatus. This time, two of the small ball modules 60 are detachably secured to the rod module 51 by inserting the plugs 61 which extend from the small ball modules 60 into respective openings 52 in the rod module 51.

Figure 7:
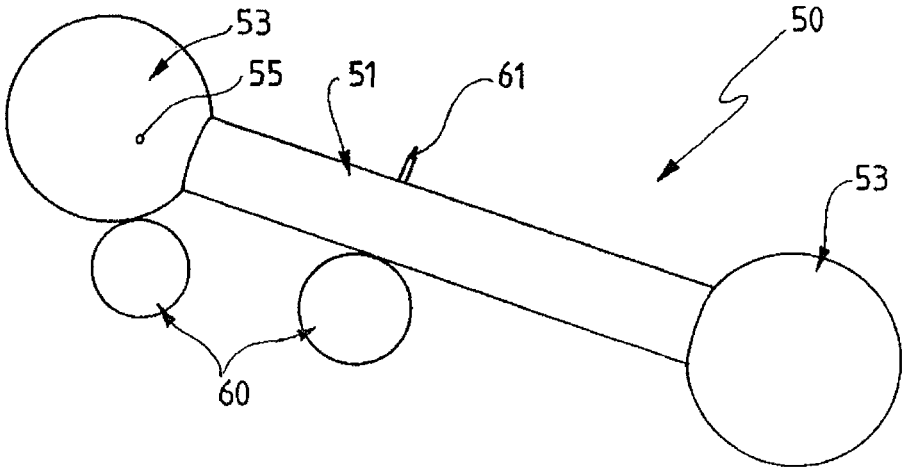
FIG. 7 depicts a fourth exemplary configuration of the exercise apparatus according to the first preferred embodiment of the present invention.

In FIG. 7, a small ball module 60 is shown detachably secured to one of the large ball modules 53, and another small ball module 60 is detachably secured to the rod module 51 of the massage apparatus 50. The plug 61 which extends from the small ball module 60 which is secured to one of the large ball modules 53 is inserted into one of the openings 55 in that ball module 53. The plug 61 which extends from the small ball module 60 which is secured to the rod module 51 is inserted into one of the openings 52 in the rod module 51.

Figure 8:
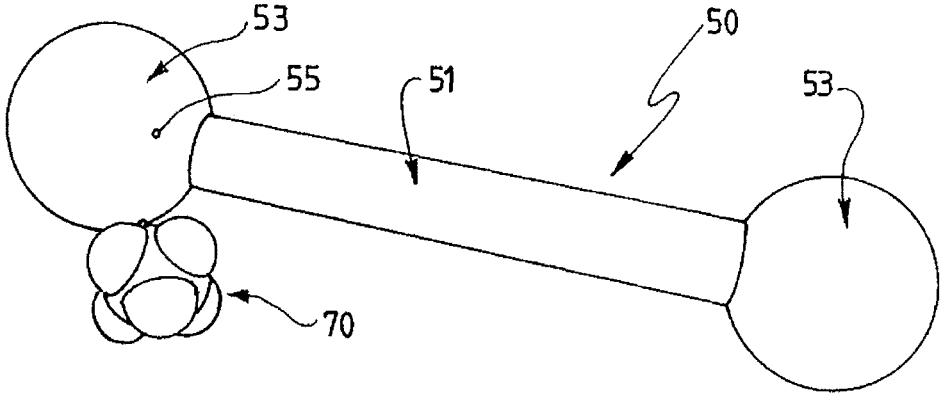
FIG. 8 depicts a fifth exemplary configuration of the exercise apparatus according to the first preferred embodiment of the present invention.

Referring to FIG. 8, the apparatus 50 is again configured as a massage apparatus. In the depicted apparatus configuration, the multi-spherical ball module 70 is detachably secured to one of the large ball modules 53 by inserting the plug 61 which extends from the module 70 into one of the openings 55 in the large ball module 53.

Figure 9:
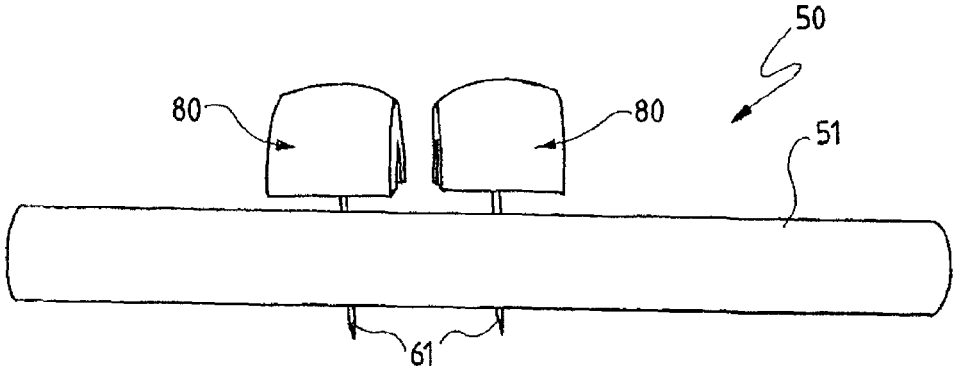
FIG. 9 depicts a sixth exemplary configuration of the exercise apparatus according to the first preferred embodiment of the present invention.

With reference to FIG. 9, two semi-toroid modules 80 are detachably secured to the rod module 51 of the massage apparatus 50 by inserting the plugs 61 which extend from the modules 80 into respective openings 52 in the rod module 51.

Figure 10:
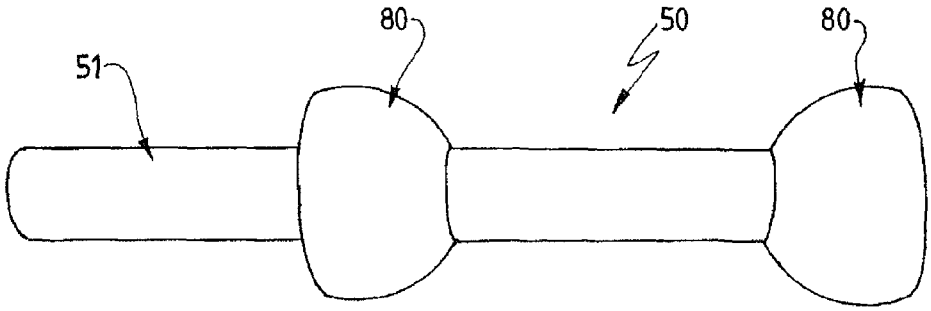
FIG. 10 depicts a seventh exemplary configuration of the exercise apparatus according to the first preferred embodiment of the present invention.

Turning to FIG. 10, two pairs of semi-toroid modules 80 are detachably secured to the rod module 51 such that the modules 80 of each pair are located on opposite sides of the rod module 51.

Figure 11:
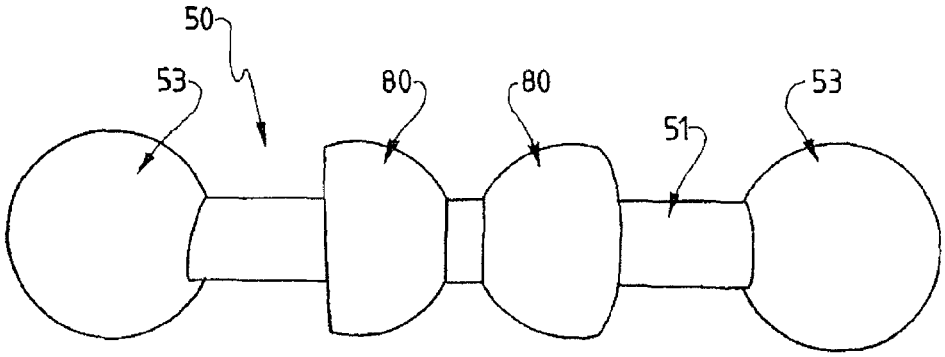
FIG. 11 depicts an eighth exemplary configuration of the exercise apparatus according to the first preferred embodiment of the present invention.

Referring to FIG. 11, two large ball modules 53 and two pairs of semi-toroid modules 80 are shown detachably secured to the rod module 51.

Figure 12:
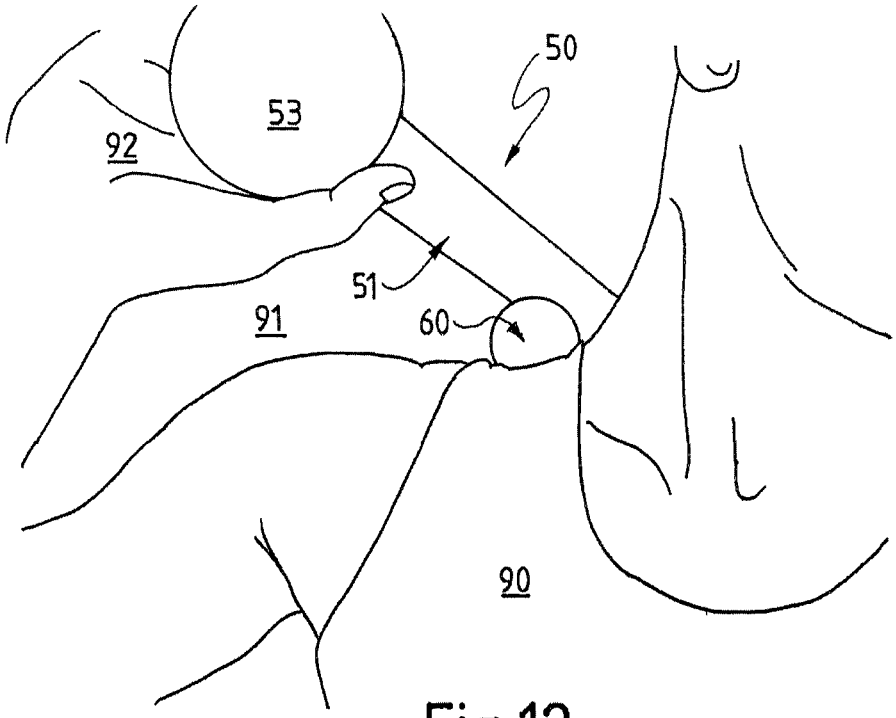
FIG. 12 depicts a person using the exercise apparatus according to the first preferred embodiment of the present invention to simultaneously massage their upper thoracic spine and their upper trapezius and levator scapulae muscles.

FIG. 12 depicts a person 90 using the massage apparatus 50 in the configuration depicted in FIG. 7 to simultaneously massage their upper thoracic spine and the upper trapezius and levator scapulae muscles of their right shoulder.

Person 90 has positioned themselves adjacent to a wall 91 such that their back faces the wall 91. Using their right hand 92 to hold on to the large ball module 53 of the apparatus 50 which does not have a smaller ball module 60 secured to it, the person 90 rests the other large ball module 53 of the apparatus 50 against the surface of the wall 91. The person 90 then positions themselves relative to the apparatus 50 so that the small ball module 60 which is secured to the rod module 51 is positioned adjacent to the upper trapezius and levator scapulae muscles which are associated with their right shoulder, and so that the other small ball module 60 is positioned adjacent to their mid thoracic spine and associated muscles.

While resting against the apparatus 50, the person 90 uses their right hand 92 to pivot the apparatus 50 relative to the wall 91 so that the small ball modules 60 apply pressure to their thoracic spine and to their upper trapezius and levator scapulae muscles. The rod module 51 functions as a lever so that the person 90 is able to use minimal effort to simultaneously apply and release pressure to their thoracic spine and their upper trapezius and levator scapulae muscles via the small ball modules 60.

Figure 13:
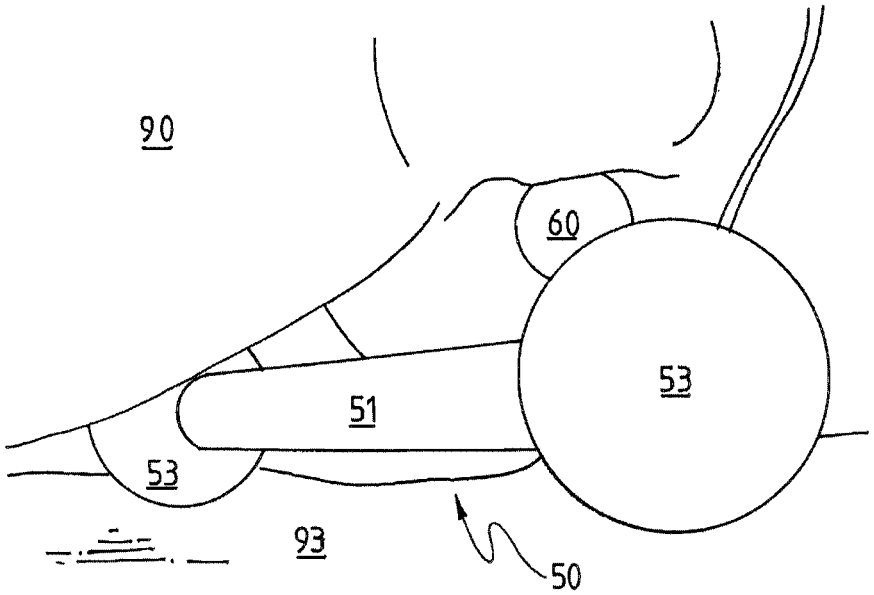
FIG. 13 depicts a person using the exercise apparatus according to the first preferred embodiment of the present invention to massage the posterior aspect of their left shoulder.

With reference to FIG. 13, a person 90 is depicted using the massage apparatus 50 to massage the posterior aspect of their left shoulder. The apparatus 50 is configured so that it only includes a single small ball module 60, and so that the module 60 is secured to one of the large ball modules 53. While lying on their back on a floor 93, the person 90 positions the apparatus 50 so that the rod module 51 extends beneath their left armpit and so that the large ball modules 53 rest on the floor 93. The apparatus 50 is also positioned so that the small ball module 60 is located adjacent to the posterior aspect of their left shoulder.

The person 90 is then able to massage the posterior aspect of their left shoulder by resting their body weight on the small ball module 60 or by otherwise pressing their body against that module.

Figure 14:
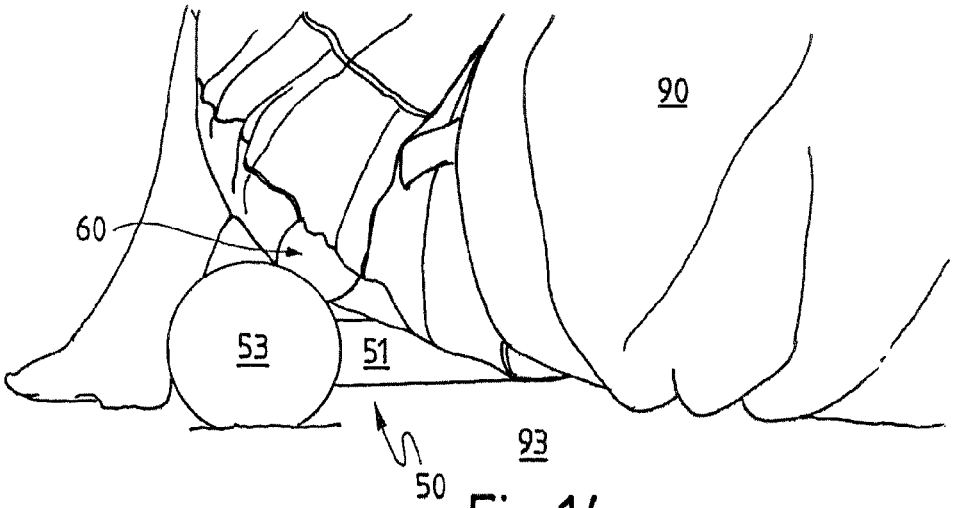
FIG. 14 depicts a person using the exercise apparatus according to the first preferred embodiment of the present invention to massage their left deep glut muscle piriformis.

Referring to FIG. 14, a person 90 is shown using the massage apparatus 50 to massage their left deep glut muscle piriformis. The large ball modules 53 of the apparatus 50 rest on the floor 93 such that the rod module 51 extends beneath their left glut muscle. A small ball module 60 which is secured to one of the large ball modules 53 is located adjacent to the left deep glut muscle piriformis of the person 90. The person 90 is able to treat their left deep glut muscle piriformis by resting their specific positional body weight on or by otherwise pressing their body against the small ball module 60.

Figure 15:
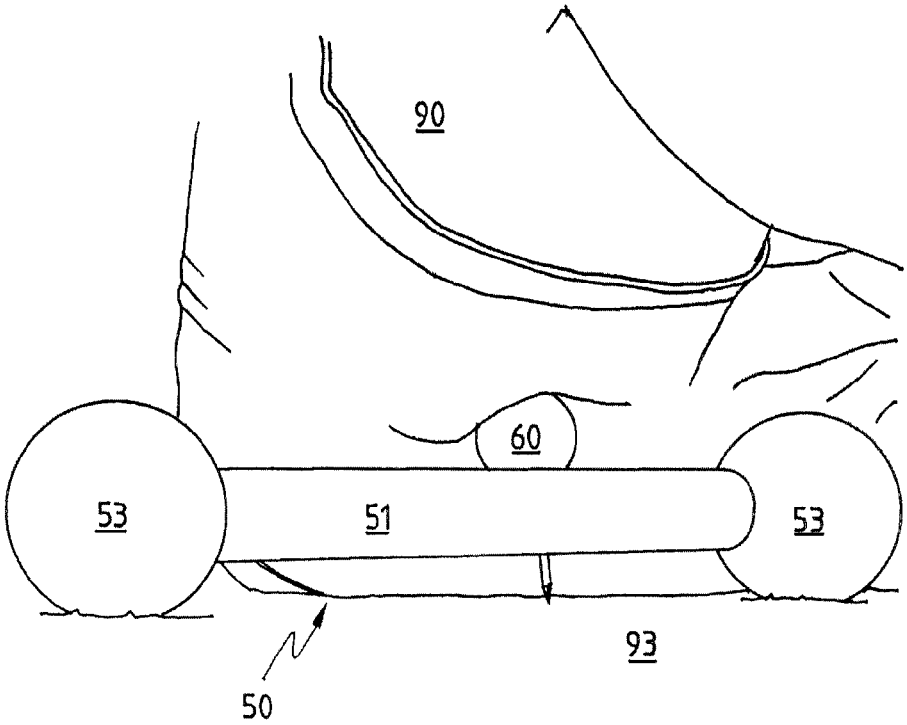
FIG. 15 depicts a person using the exercise apparatus according to the first preferred embodiment of the present invention to massage the hamstring muscle in their right leg.

FIG. 15 depicts a person 90 using the massage apparatus 50 to treat the hamstring muscle in their right leg. The large ball modules 53 of the apparatus 50 rest on the floor 93 such that the rod module 51 extends beneath the hamstring muscle of the person's right leg. A small ball module 60 which is secured to the rod module 51 is located adjacent to the hamstring muscle. The person 90 is able to massage their hamstring muscle by pressing it against the small ball module 60. While pressing the module 60 against their hamstring muscle, the person 90 can hold on to one of the large ball modules 53 and move that module 53 in an oscillating manner relative to the ground 93 and their hamstring muscle.

Figure 16:
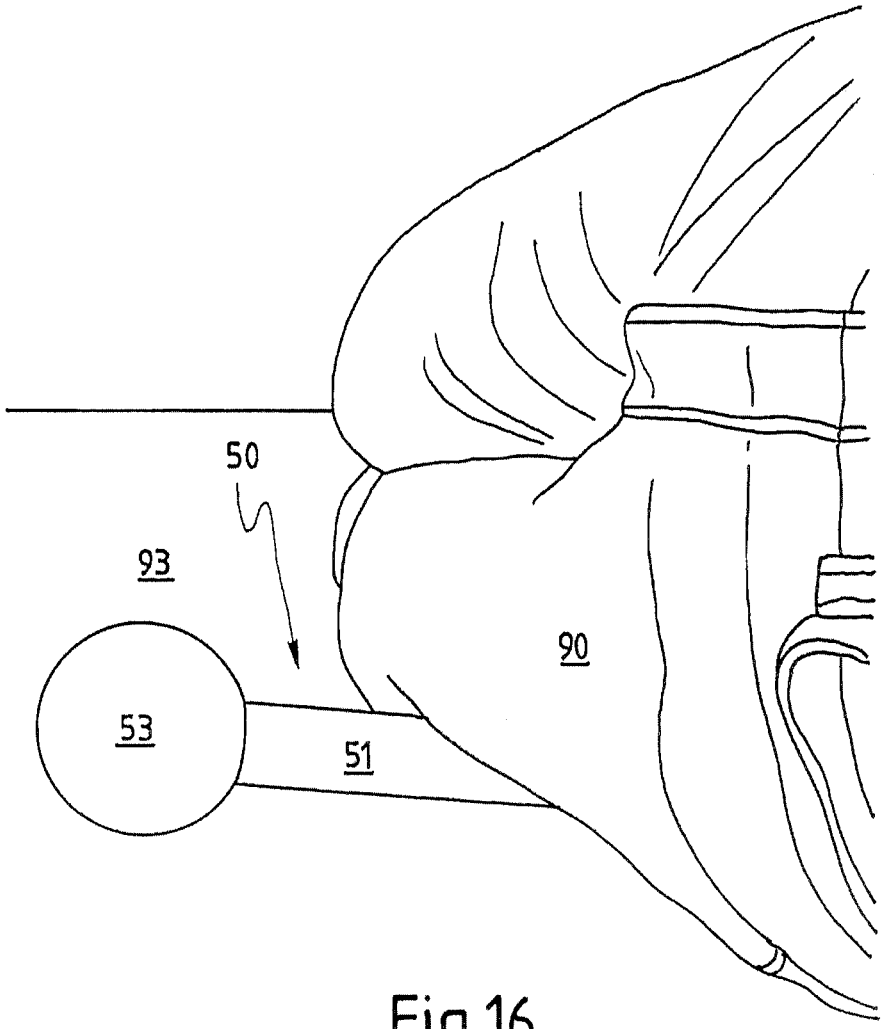
FIG. 16 depicts a person using the exercise apparatus according to the first preferred embodiment of the present invention to massage the lateral quadricep muscle and Ilio tibial band (ITB) of their left leg.

With reference to FIG. 16 a person 90 is depicted using the massage apparatus 50 to massage the lateral quadricep muscle and Ilio tibial band (ITB) of their left leg. The large ball modules 53 of the apparatus 50 rest on the floor 93 such that the rod module 51 extends beneath the lateral quadricep muscle and the Ilio tibial band (ITB) of the person's left leg. A small ball module 60 of the apparatus 50 is located adjacent to the lateral quadricep muscle and Ilio tibial band (ITB) so that the person 90 is able to treat those areas of their body by resting their body weight on or by otherwise pressing their body against the small ball module 60, the large ball module 53, or both the rod module 51 and the large ball module 53. While their body is pressed against the rod module 51, the person 90 may move back and forth so that the rod module 51 moves back and forth along a specific area of their body. The apparatus 50 may be used in the aforementioned manner without the small ball module 60.

Applying pressure and directional force to the body of a person in order to treat musculoskeletal pain is an effective method of treating such pain. In fact, this method of treatment is used by physiotherapists and other health professionals to treat musculoskeletal pain. The apparatus 50 enables individuals who suffer from musculoskeletal aches and pains to take control of their condition and to significantly reduce their dependence upon other people such as physiotherapists and other health professionals.

The apparatus 50 allows individuals to effectively stretch and release tight muscles, and associated soft tissue through an available movement range. This results in the freeing up of stiff joints, and therefore improves movement patterns resulting in further significant relief from musculoskeletal pain.

Figure 17:
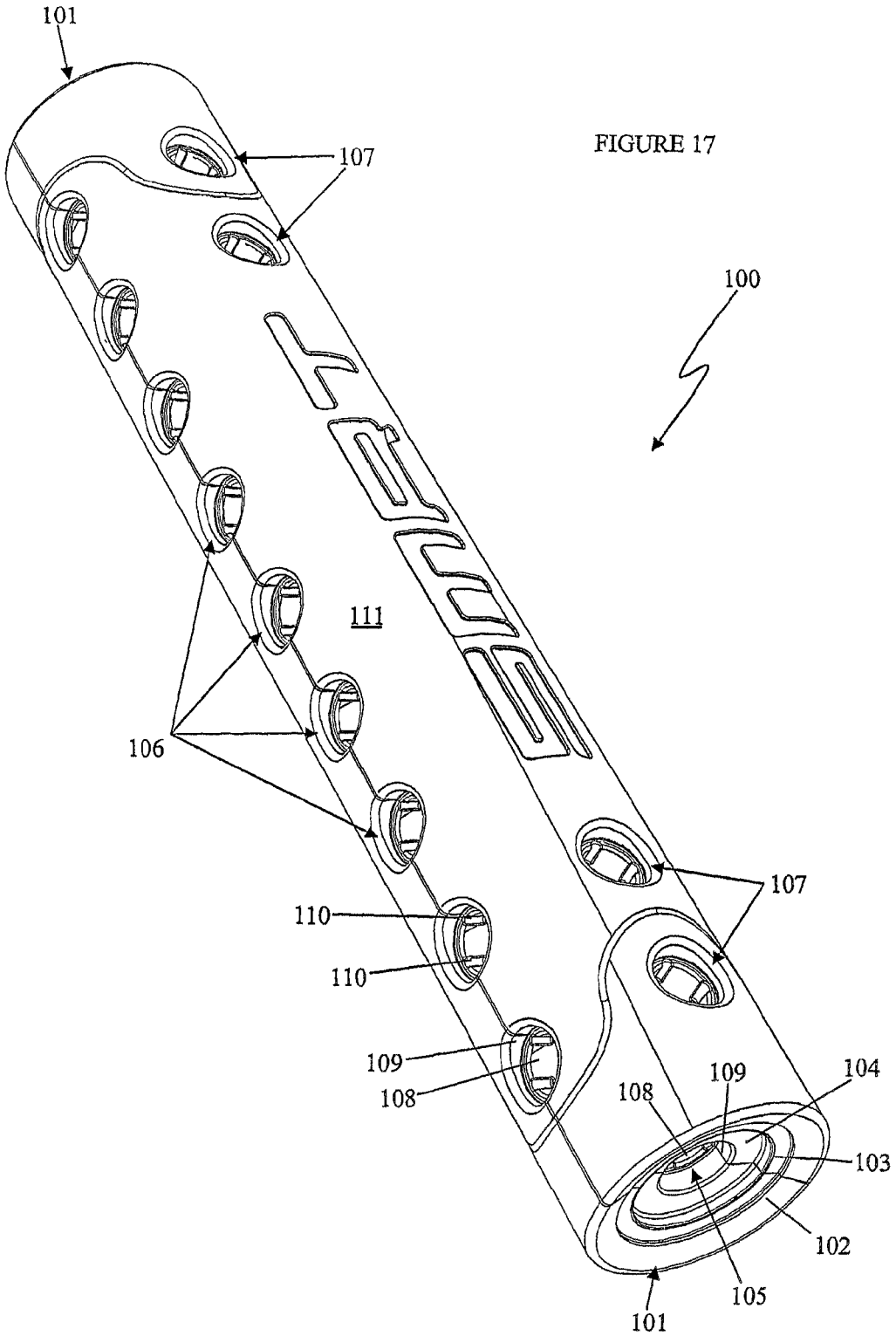
FIG. 17 depicts a rod module of an exercise apparatus according to a second preferred embodiment of the present invention.

Referring to FIG. 17, a rod module 100 of an exercise apparatus according to a second preferred embodiment of the present invention is substantially cylindrical in shape.

Rod module 100 preferably is approximately 250 mm long, and preferably has a diameter of approximately 40 mm.

Each end 101 of the module 100 includes a first surface 102, a second surface 103 which is recessed below the first surface 102, and a third surface 104 which is recessed below the second surface 103. A circular opening 105 extends through the rod module 100 from one end 101 of the module 100 to the other end 101 of the module 100.

A plurality of regularly spaced and parallel circular openings 106 extend laterally through the rod module 100. Openings 106 are perpendicular to the opening 105 which extends through the module 100. Also, openings 106 intersect the opening 105.

A plurality of parallel circular lateral openings 107 also extend completely through the rod module 100. Openings 107 are perpendicular to openings 105 and 106, and also intersect those openings.

Apart from their respective lengths, openings 105, 106 and 107 are all the same size and shape. Each end of each opening 105, 106, 107 includes a narrower portion 108 which is recessed below a wider portion 109. The narrower portion 108 includes four parallel and circumferentially spaced grooves 110 which extend into the narrower portion 108 from the wider portion 109.

Rod module 101 is fabricated from plastic and includes a non-slip surface 111.

FIG. 18 depicts a large spherical ball module 120 of the multi-functional exercise apparatus according to the second preferred embodiment of the present invention.

The large ball module 120 has a diameter of approximately 90 mm and is approximately the size of a softball.

Module 120 includes a plurality of spaced circular openings 121 which extend completely through the module 120. Openings 121 are regularly spaced along the middle of the module 120, and intersect each other at the centre of the module 120.

Each end of each opening 121 includes a narrower portion 122 which is recessed below a wider portion 123. The narrower portion 122 includes four parallel and circumferentially spaced grooves 124 which extend into the narrower portion 122 from the wider portion 123.

Large ball module 120 is fabricated from plastic and includes a non-slip surface 125.

A small spherical ball module 130 of the multi-functional exercise apparatus according to the second preferred embodiment of the present invention is depicted in FIGS. 19 and 20.

The small ball module 130 has a diameter of approximately 65 mm and is approximately the size of a golf ball.

Module 130 includes a circular opening 131 which extends completely through the module 130 such that it passes through the centre of the module 130. In addition, it includes a circular opening 132 which is perpendicular to the opening 131, and which only extends into the module 130 until it intersects the opening 131.

Apart from their lengths, openings 131 and 132 are identical to each other. Each opening 131, 132 includes a narrower portion 133 which is recessed below a wider portion 134. The narrower portion 133 includes four parallel and circumferentially spaced grooves 135 which extend into the narrower portion 133 from the wider portion 134.

Small ball module 130 is fabricated from plastic and includes a non-slip surface 136.

Figure 21:
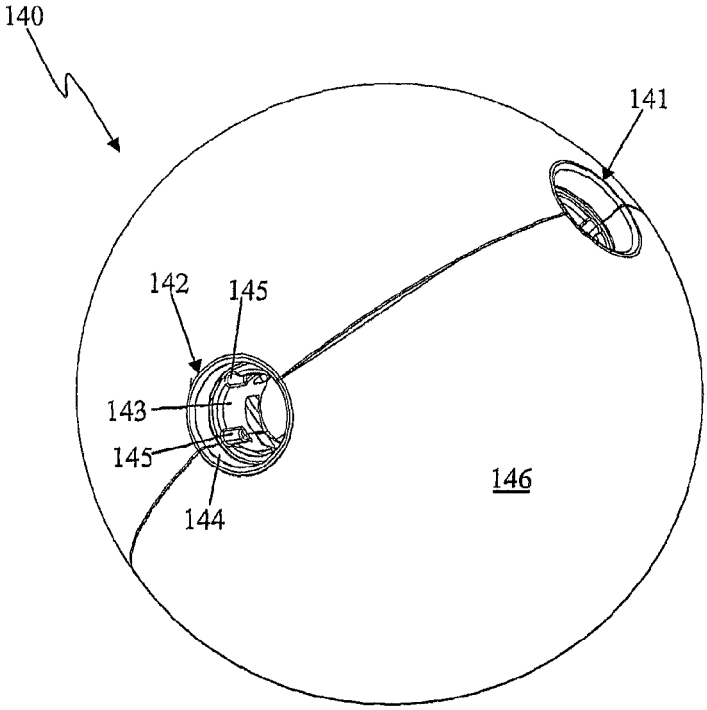
FIG. 21 is a first perspective view of a medium ball module of the exercise apparatus according to the second preferred embodiment of the present invention.
Figure 22:
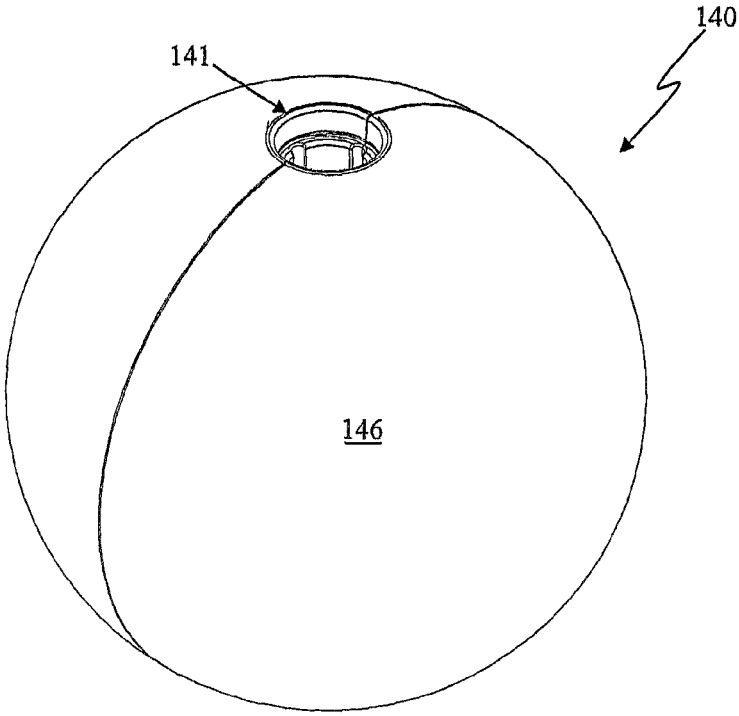
FIG. 22 is a second perspective view of the ball module depicted in FIG. 21.

A medium spherical ball module 140 of the multi-functional exercise apparatus according to the second preferred embodiment of the present invention is depicted in FIGS. 21 and 22.

The medium ball module 140 has a diameter of approximately 65 mm and is approximately the size of a tennis ball.

Module 140 includes a circular opening 141 which extends completely through the module 140 such that it passes through the centre of the module 140. In addition, it includes a circular opening 142 which is perpendicular to the opening 141, and which only extends into the module 140 until it intersects the opening 141.

Apart from their lengths, openings 141 and 142 are identical to each other. Each opening 141, 142 includes a narrower portion 143 which is recessed below a wider portion 144. The narrower portion 143 includes four parallel and circumferentially spaced grooves 145 which extend into the narrower portion 143 from the wider portion 144.

Medium ball module 140 is fabricated from plastic and includes a non-slip surface 146.

Figure 23:
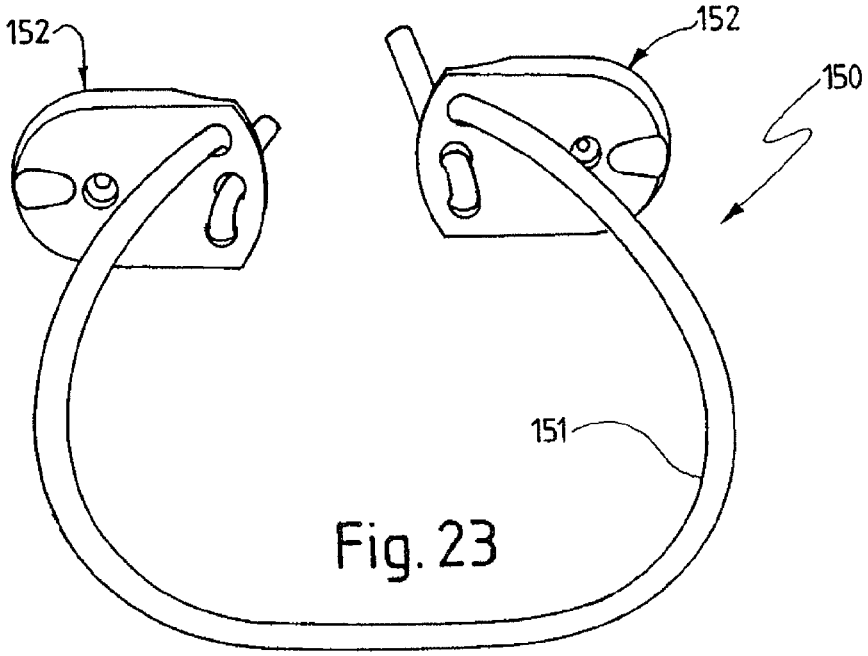
FIG. 23 depicts a strength training module of the exercise apparatus according to the second preferred embodiment of the present invention.
Figure 24:
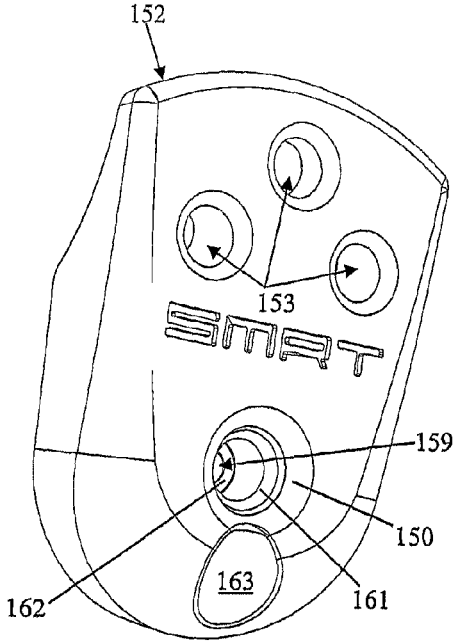
FIG. 24 is a front perspective view of an anchor of the strength training module depicted in FIG. 23.
Figure 25:
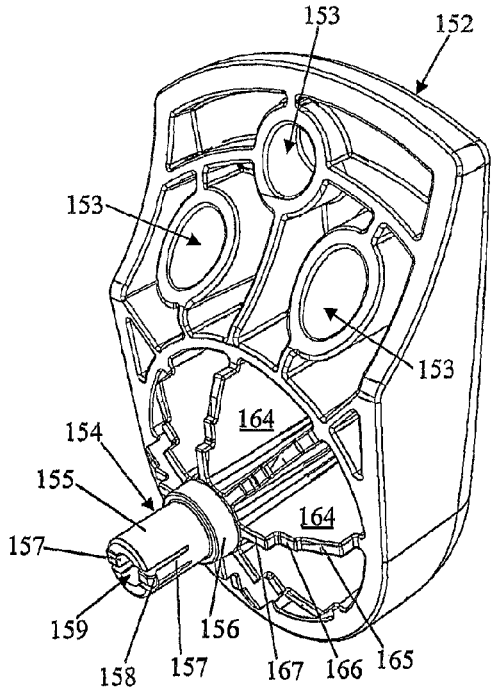
FIG. 25 is a rear perspective view of the anchor depicted in FIG. 24.

Referring to FIGS. 23 to 25, a strength training module 150 of the multi-functional exercise apparatus according to the second preferred embodiment of the present invention comprises a length of elastic tubing 151, and a respective anchor 152 secured to each end of the tubing 151.

Each anchor 152 is fabricated from moulded plastic and includes three circular openings 153 for adjustably securing the tubing 151 to the anchor 152. The tubing 151 can be secured to the anchor 152 by weaving the tubing 151 in and out of the openings 153 as depicted in FIG. 23. The length of the portion of the tubing 151 which extends between the anchors 152 can be adjusted by pulling more of the tubing 151 through the openings 153.

Each anchor 152 also includes a hollow cylindrical plug 154. Plug 154 includes a narrower portion 155 and a wider portion 156. The narrower portion 155 includes a pair of diametrically opposed and resilient latch arms 157. Each latch arm 157 includes a protrusion 158 which is located at the end of the arm 157 and which extends outwardly from the plug 154.

A circular opening 159 extends completely through the plug 154 and the anchor 152. One end of the opening 159 is countersunk/enlarged and includes a curved first surface 160, a curved second surface 161 which is recessed below the first surface 160, and a flat third surface 162 which is recessed below the second surface 161.

A shallow curved recess 163 is located adjacent to the countersunk/enlarged end of the opening 159.

A plurality of ribs 164 extend radially from the plug 154. Each rib 164 includes a first surface 165, a second surface 166 located above the first surface 165, and a third surface 167 located above the second surface 166.

Plug 154 is adapted to be removably inserted into any of the openings 105 to 107 of the rod module 100, any of the openings 121 of the large ball module 120, any of the openings 131, 132 of the small ball module 130, and any of the openings 141, 142 of the medium ball module 140. In particular, the plug 154 is adapted so that its wider portion 156 is received by the wider portion of the aforementioned openings, and so that its narrower portion 155 is received by the narrower portion of the aforementioned openings.

As the plug 154 is inserted into an opening of one of the modules 100, 120, 130 or 140, the narrower portion of the opening presses against the projection 158 of each latch arm 157 so that the resilient latch arms 157 are moved towards each other. Once the plug 154 has been fully inserted into the opening, each projection 158 is received by a latch recess which is located in the opening so that the latch arms 157 spring out to their original position and interlock with the latch recess. The latch arms 157 and the latch recess are therefore able to inhibit the plug 154 from being unintentionally withdrawn from the opening.

Figure 26:
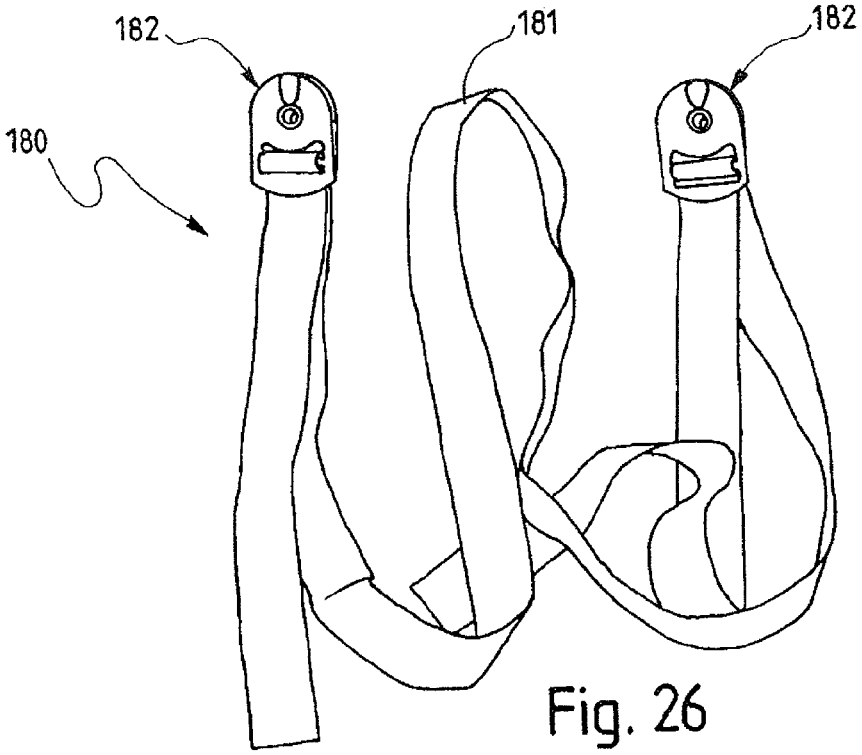
FIG. 26 is a stretching module of the exercise apparatus according to the second preferred embodiment of the present invention.
Figure 27:
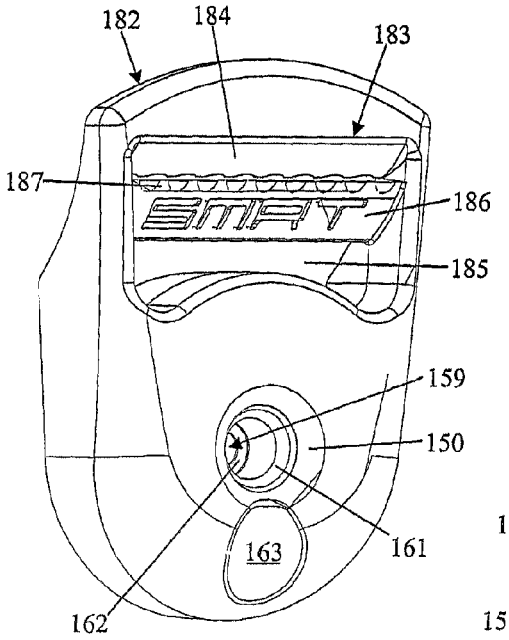
FIG. 27 is a front perspective view of an anchor of the stretching module depicted in FIG. 26.
Figure 28:
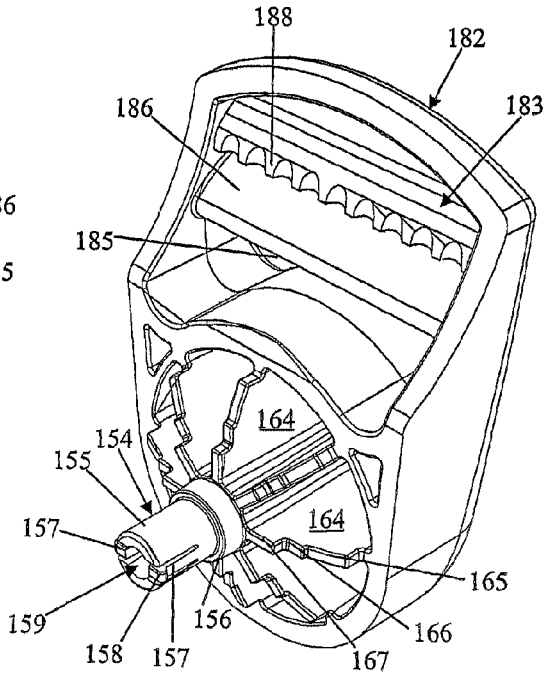
FIG. 28 is a rear perspective view of the anchor depicted in FIG. 27.

Referring to FIGS. 26 to 28, a stretching module 180 of the multi-functional exercise apparatus according to the second preferred embodiment of the present invention comprises a length of webbing 181, and a respective anchor 182 secured to each end of the webbing 181.

Anchor 182 is similar to the anchor 152. Therefore, for convenience, like features of the anchors 152, 182 have been referenced with like reference numerals.

Anchor 182 is identical to the anchor 152 except that, instead of the openings 153 of the anchor 152, anchor 182 includes a buckle portion 183. Buckle portion 183 includes a first elongate aperture 184, and a second elongate aperture 185 which is separated from the first aperture 184 by a separating bar 186. Bar 186 includes a serrated edge 187 which is located adjacent to the first aperture 184. Another serrated edge 188 is located on an opposite side of the aperture 184, and on an opposite side of the anchor 182 to the serrated edge 187.

Webbing 181 is adjustably secured to the anchor 182 by weaving the webbing 181 in and out of the apertures 184, 185 as depicted in FIG. 26 so that the serrated edges 187, 188 of the anchor 182 are able to bite into the webbing 181 and inhibit the webbing 181 from being unintentionally withdrawn from the anchor 182.

Anchor 182 can be secured to any one of the modules 100, 120, 130, 140 in the same manner as the anchor 152 of the elastic strap module 150. For example, Each anchor 182 of the stretching belt module 180 may be secured to a respective end 101 of the rod module 100 by inserting the plug 154 of each anchor 182 into a respective end of the opening 105. When the anchor 182 is secured to an end 101 of the rod module 100 in this manner, the first surface 165, second surface 166, and third surface 167 of each rib 164 of the anchor 182 abuts against the first surface 102, second surface 103, and third surface 104, respectively, of the rod module end 101.

Figure 29:
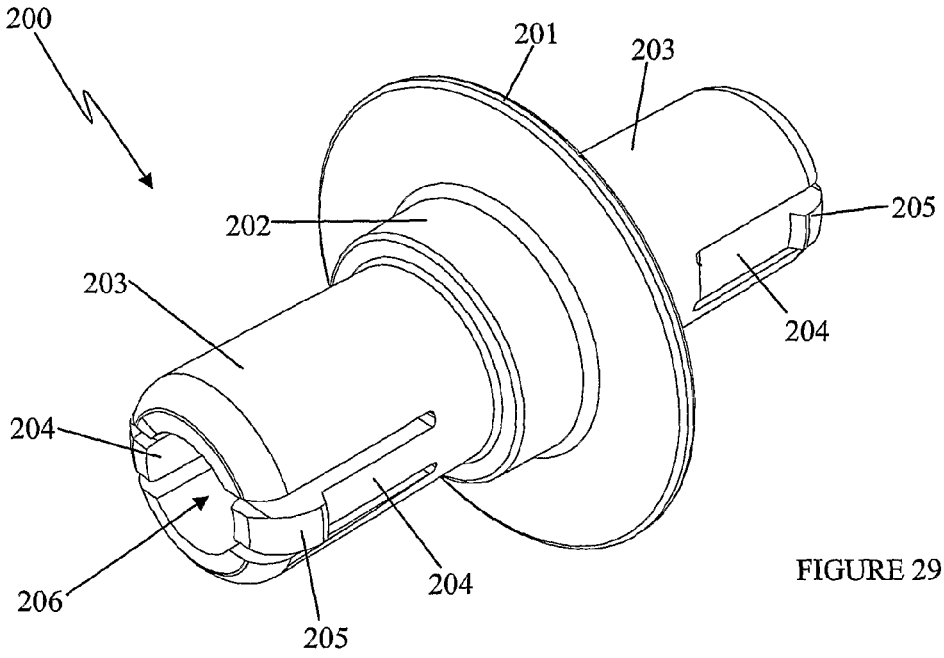
FIG. 29 is a perspective view of a short rotatable plug of the exercise apparatus according to the second preferred embodiment of the present invention.

FIG. 29 depicts a plug 200 which may be used to secure together two of the modules 100, 120, 130, 140 in any combination. Plug 200 is fabricated from plastic and includes a circular flange 201 which is located between two cylindrical portions 202. A respective narrower cylindrical portion 203 extends from each of the cylindrical portions 202. Each of the narrower portions 203 includes a pair of diametrically opposed and resilient latch arms 204. Each latch arm 204 includes a protrusion 205 which is located at the end of the arm 204 and which extends outwardly from the plug 200. A circular opening 206 extends from one end of the plug 200 through to the other end of the plug 200.

Two modules 100, 120, 130, 140 can be detachably secured together with the plug 200 by inserting each end of the plug 200 into a respective opening in each module. When the plug 200 is inserted into the openings, the narrower portions 203 of the plug 200 are received by the narrower portions of the openings, and the wider portions 202 of the plug 200 are received by the wider portions of the openings.

As the plug 200 is inserted into the openings, the narrower portions of the openings press against the projection 205 of each latch arm 204 so that the resilient latch arms 204 are moved towards each other. Once the plug 200 has been fully inserted into the openings, the projections 205 are received by latch recesses in the openings so that the latch arms 204 spring out to their original positions and interlock with the latch recesses. The latch arms 204 and the latch recesses are therefore able to inhibit the plug 200 from being unintentionally withdrawn from the openings in the modules.

The flange 201 of the plug 200 functions to limit the maximum extent to which the plug 200 is able to be inserted into an opening of one of the modules 100, 120, 130, 140.

Figure 30:
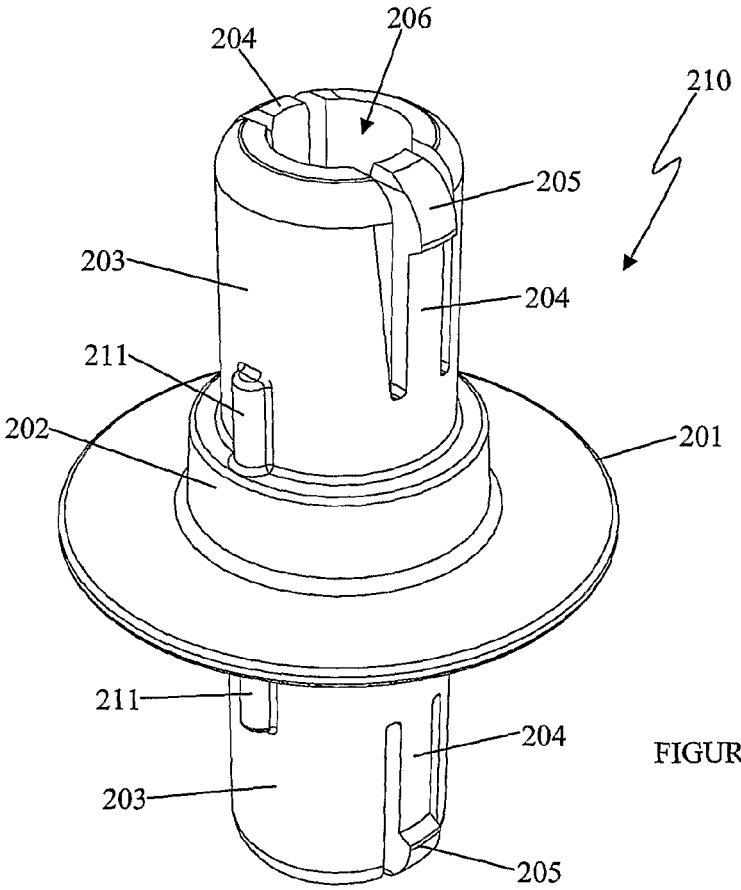
FIG. 30 is a perspective view of a short non-rotatable plug of the exercise apparatus according to the second preferred embodiment of the present invention.

Although the latch arms 204 and the latch recesses are able to inhibit the plug 200 from being unintentionally withdrawn from the openings, the plug 200 is nevertheless still able to rotate relative to the openings even when the latch arms 204 and the latch recesses are interlocked with each other. To prevent such rotation, a modified plug 210 which is depicted in FIG. 30 may be employed instead of the plug 200.

Plug 210 is similar to plug 200. Therefore, for convenience, like features of the plugs 200 and 210 have been referenced using like reference numerals.

Plug 210 is identical in all respects to plug 200, except that a respective pair of diametrically opposite ridges 211 extend from each of the cylindrical portions 203 of the plug 210.

When the plug 210 is used to detachably secure together two modules 100, 120, 130, 140, each ridge 211 of the plug 210 is received by a respective groove in the narrower portions of the module openings which receive the plug 211 so that the plug 210 is thereby prevented from being able to rotate relative to the module.

For example, if one end of the plug 210 is plugged into one of the openings 106 of the rod module 100, each ridge 211 of the plug 210 which is located adjacent to that end is received by a respective one of the grooves 110 in the narrower portion 108 of the opening 106 so that the plug 210 is thereby prevented from rotating relative to the rod module 100.

FIG. 31 depicts a plug 220 which is similar to the plug 200. For convenience, like features of the plugs 200, 220 have been referenced using like reference numerals.

Plug 220 differs from plug 200 in that its narrower cylindrical portions 203 are longer than those of the plug 200. Also, the cylindrical portions 203 of the plug 220 each include a plurality of grooves 204*a*.

Unlike the cylindrical portions 203 of the plug 200, the cylindrical portions 203 of the plug 220 are long enough so that when they are inserted into an opening of one of the modules 100, 120, 130, 140, they are able to block the other openings in the module which intersect that opening. Moreover, the additional length of the plug 220 means that it is better able to reinforce the apparatus which it forms a part of compared to the plug 200.

FIG. 32 depicts a plug 230 which is similar to the plug 220. For convenience, like features of the plugs 220, 230 have been referenced using like reference numerals.

Plug 230 differs from plug 220 in that, like plug 210, it also has a respective pair of diametrically opposed ridges 211 extending from each of its cylindrical portions 203 which are able to be received by the grooves in the module openings into which the plug 230 is inserted, and which are thereby able to prevent the plug 230 from rotating relative to the openings.

Figure 33:
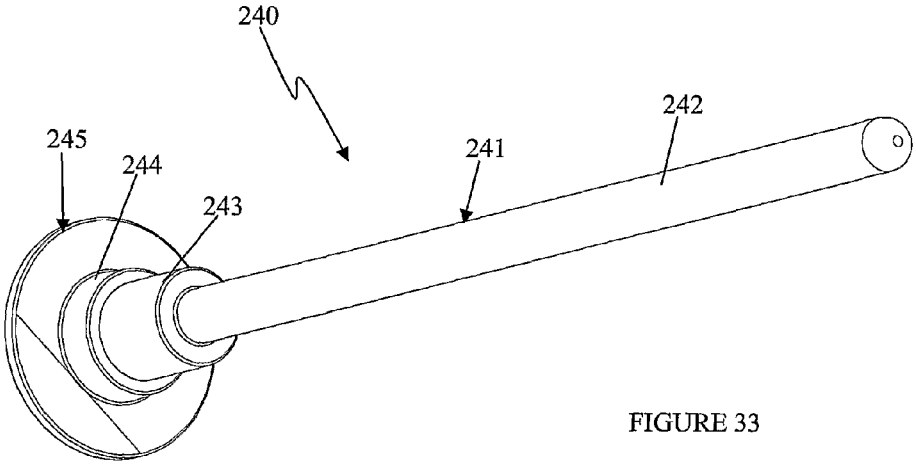
FIG. 33 is a perspective view of a locking pin of the exercise apparatus according to the second preferred embodiment of the present invention.

Referring to FIG. 33, a locking pin 240 of the multi-functional exercise apparatus according to the second preferred embodiment of the present invention includes an elongate cylindrical shaft 241. Shaft 241 includes a first portion 242, a second portion 243, and a third portion 244. A substantially flat plastic head 245 is over-moulded with the third portion 244 of the shaft 241.

The diameter of the first portion 242 of the shaft 241 of the locking pin 240 is slightly less than the diameter of the openings which extend through the modules 100, 120, 130, 140 and the plugs 154, 200, 210, 220 and 230 so that the shaft 241 is able to be inserted through those openings.

The diameter of the recessed/countersunk end portions of the openings in the modules 100, 120, 130, 140 and the anchors 152, 182 are such that they are able to accommodate the second and third portions 243, 244 of the shaft 241.

When the shaft 241 of the locking pin 240 is inserted into a plug 154, 200, 210, 220 or 230 which has itself been inserted into an opening in one of the modules 100, 120, 130, 140, the shaft 241 is able to prevent the latch arm of the plug from disengaging with the latch recess of the module opening. By preventing the latch arm from disengaging with the latch recess, the locking pin 240 is able to prevent, or at least further inhibit, the plug from being unintentionally removed from the opening. The locking pin is therefore particularly suitable for use where the apparatus is subjected to relatively high torsion loads which may increase the risk of unintentional disengagement of the latch arm from the latch recess which could lead to the plug being unintentionally withdrawn from the module opening.

Figure 34:
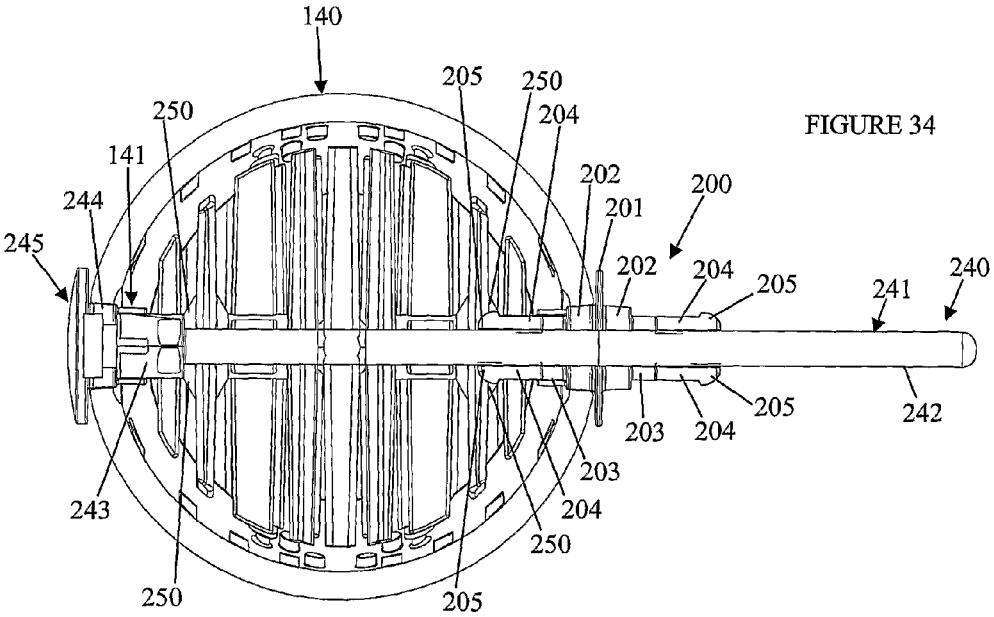
FIG. 34 is a cross-section of the medium ball module depicted in FIGS. 21 and 22 when the short rotatable plug depicted in FIG. 29 is inserted into the module, and when the locking pin depicted in FIG. 33 is inserted through both the module and the plug.

FIG. 34 depicts the locking pin 240 when its shaft 241 has been inserted into the medium ball module 140 through one end of the opening 141, and into the opening 206 of the plug 200 which itself has been inserted into the other end of the opening 141 so that it is secured relative to the module 140.

The protrusions 205 of the latch arms 204 of the plug 200 which are received by the opening 141 are each received by a latch recess 250 located inside the opening 141 so that the plug 200 is thereby inhibited from being withdrawn from the opening 141. The shaft 241 of the locking pin 240 prevents the latch arms 204 from being pushed towards each other to remove the protrusions 205 from the latch recesses 250. The latch arms 204 can only be moved in the aforementioned manner once the locking pin 240 is removed from the plug 200.

It can be seen that the shaft 241 is sufficiently long that an end portion thereof protrudes out of the module 140 when the locking pin 240 has been fully inserted into the module 140 as depicted in FIG. 34.

It can also be seen from FIG. 34 that when the locking pin 240 is fully inserted into the module 140, the second portion 243 of the shaft 241 is received by the narrower portion 143 of the opening 141, that the third portion 244 is received by the wider portion 144 of the opening 141, and that the head 245 of the locking pin 240 rests against the outside of the module 140.

The openings of each of the modules 100, 120, 130 also include a latch recess which is similar to the latch recess 250 of the medium ball module 140 depicted in FIG. 34.

Figure 35:
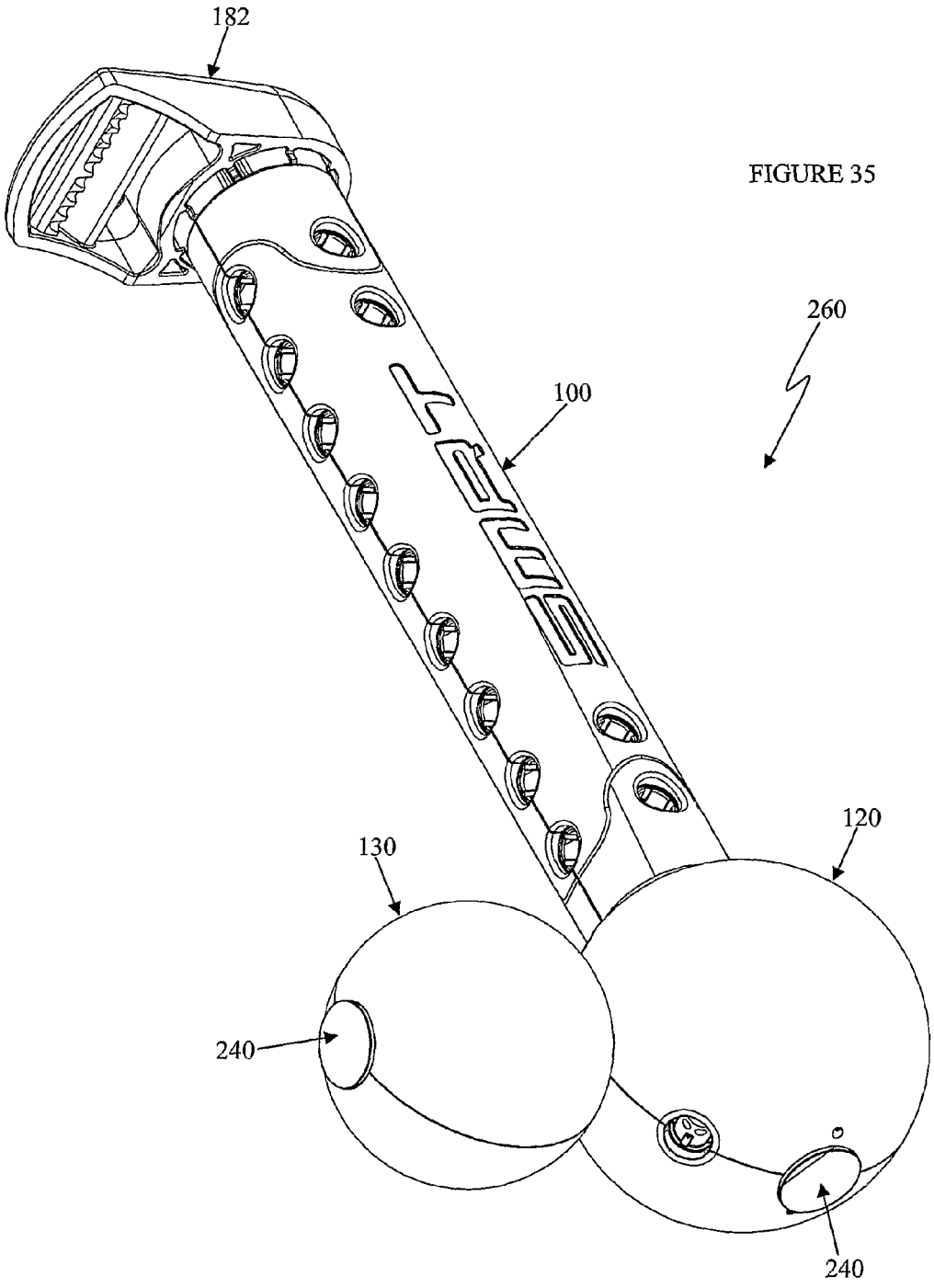
FIG. 35 is a perspective view of an exemplary configuration of the exercise apparatus according to the second preferred embodiment of the present invention.

FIG. 35 depicts the multi-functional exercise apparatus according to the second preferred embodiment of the present invention when the apparatus has a particular configuration 260.

The apparatus includes the rod module 100 depicted in FIG. 17. It also includes an anchor 182 of the stretching module 180 depicted in FIG. 26. Anchor 182 is detachably secured to the rod module 100 by inserting the plug 154 of the anchor 182 into one of the openings 105 in the rod module 100 in the manner described previously.

The large ball module 120 depicted in FIG. 18 is detachably secured to the other end of the rod module 100 by the plug 230 depicted in FIG. 32. One end of the plug 230 is inserted into one of the openings 121 of the ball module 120. The other end of the plug 230 is inserted into the opening 105 in the rod module 100. The locking pin 240 is inserted into the other end of the opening 121 such that its shaft 241 extends through the module 120, plug 230 and into the rod module 100.

The medium ball module 140 depicted in FIGS. 21 and 22 is detachably secured to the large ball module 120 by another one of the plugs 230. One end of the plug 230 is inserted into one of the available openings 121 of the large ball module 120. The other end of the plug 230 is inserted into an end of the opening 141 in the medium ball module 140. Another locking pin 240 is inserted into the other end of the opening 141 such that its shaft 241 extends through the module 130, plug 230 and into the large ball module 120.

Two or more of the same or different modules 100, 120, 130, 140, 150, 180 may be detachably secured together in any desired combination to form an apparatus which has a particular desired functionality. For example, one or more of the ball modules 120, 130, 140 may be secured relative to the rod module 100 to form a massage apparatus which can be used in a similar manner to the way in which the apparatus 50 is used.

As another example, the strength training module 150 may be detachably secured to the rod module 100 such that each anchor 152 of the module 150 is attached to a respective end 101 of the rod module 100. The resultant apparatus can be used as a strength training module 150 where the elastic tubing 151 of the module 150 is able to provide resistance to the movement of a user's particular muscle or muscle group, so that the user can thereby strengthen that muscle or muscle group.

The stretching module 180 may, for example, be detachably secured to the rod module 100 in a similar manner so that a user can use the resultant apparatus as a muscle stretching exercise aid in any suitable manner.

Throughout the specification and the claims, unless the context requires otherwise, the term "comprise", or variations such as "comprises" or "comprising", will be understood to apply the inclusion of the stated integer or group of integers but not the exclusion of any other integer or group of integers.

Throughout the specification and claims, unless the context requires otherwise, the term "substantially" or "about" will be understood to not be limited to the value for the range qualified by the terms.

It will be appreciated by those skilled in the art that variations and modifications to the invention described herein will be apparent without departing from the spirit and scope thereof. The variations and modifications as would be apparent to persons skilled in the art are deemed to fall within the broad scope and ambit of the invention as herein set forth.

It will be clearly understood that, if a prior art publication is referred to herein, that reference does not constitute an admission that the publication forms part of the common general knowledge in the art in Australia or in any other country.

The invention claimed is:

1. An apparatus for use in exercise, massage, strength training or muscle stretching, the apparatus comprising:

a first module, wherein the first module is a rod module which has a plurality of openings, one or more second modules, wherein each second module is detachably securable to the rod module by a plug wherein said plug is removably insertable into an opening in the rod module to thereby detachably secure the second module to the rod module, wherein the openings in the rod module include:

an axial opening in each end of the rod module, a plurality of first lateral openings, the first lateral openings being parallel to one another and extending through the rod module at spaced locations along the rod module, and a plurality of second lateral openings, the second lateral openings also extending through the rod module but in a direction perpendicular to the first lateral openings, wherein one or more second modules can be detachably secured to the rod module in a plurality of configurations.

2. The apparatus as claimed in claim 1, wherein the first lateral openings are circular and spaced regularly along a length of the rod module.

3. The apparatus as claimed in claim 2, wherein the second lateral openings are circular, there are second lateral openings located towards each end of the rod module, each second lateral opening intersects with the axial opening which is in the end of the rod module which said second lateral opening is close to, and each second lateral opening intersects with a first lateral opening.

4. The apparatus as claimed in claim 1, wherein at least one second module comprises a substantially spherical ball module.

5. The apparatus as claimed in claim 4, wherein multiple substantially spherical ball modules are provided of the same or differing sizes.

6. The apparatus as claimed in claim 4 wherein, for at least one given ball module, each said given ball module has multiple openings therein which are spaced from one another, each opening being operable to receive a plug, such that the rod module or another module can be detachably secured to the given ball module at more than one location relative to the given ball module, or such that multiple modules can be detachably secured to the given ball module at a time.

7. The apparatus as claimed in claim 1, wherein at least one second module comprises a substantially hemispherical module.

8. The apparatus as claimed in claim 1 wherein, for at least one second module, the plug by which that second module is detachably securable to another module is part of, and extends from, that second module.

9. The apparatus as claimed in claim 1 wherein, for at least one second module, the plug by which that second module is detachably securable to another module is a separate component from the second module and is detachably securable to the second module to thereby allow the second module to be detachably secured to another module.

10. The apparatus as claimed in claim 1, wherein at least one second module comprises a strength training module, wherein the strength training module includes an elastic strap and a pair of anchor modules which are releasably securable to the strap at different locations along the strap, and wherein each anchor module is detachably securable to the rod module by a plug.

11. The apparatus as claimed claim 1, wherein at least one second module comprises a stretching module, wherein the stretching module includes a substantially inelastic belt and a pair of anchor modules which are releasably securable to the belt at different locations along the belt, and wherein each anchor module is detachably securable to the rod module by a plug.

12. The apparatus as claimed claim 1, wherein at least one plug includes an opening therein, and the apparatus also includes one or more locking pins, each locking pin being operable to insert into the opening in a said plug to inhibit removal of that plug.

13. The apparatus as claimed in claim 12 wherein, the said opening in a plug extends laterally through that plug.

14. The apparatus as claimed claim 1, wherein two respective second modules can be secured relative to each other such that they are able to rotate relative to each other.

15. The apparatus as claimed claim 1, wherein two respective second modules can be secured relative to each other such that they are unable to rotate relative to each other.

* * * * *